US008142270B2

(12) United States Patent
Tsutsui et al.

(10) Patent No.: US 8,142,270 B2
(45) Date of Patent: Mar. 27, 2012

(54) GAME SYSTEM AND GAME CONTROL METHOD

(75) Inventors: Ryo Tsutsui, Tokyo (JP); Hiroyuki Uchida, Tokyo (JP)

(73) Assignee: Kabushiki Kaisha Sega, Tokyo (JP)

( * ) Notice: Subject to any disclaimer, the term of this patent is extended or adjusted under 35 U.S.C. 154(b) by 536 days.

(21) Appl. No.: 12/351,136

(22) Filed: Jan. 9, 2009

(65) Prior Publication Data

US 2009/0181740 A1 Jul. 16, 2009

(30) Foreign Application Priority Data

Jan. 11, 2008 (JP) ..... 2008-005004

(51) Int. Cl.
*A63F 9/24* (2006.01)

(52) U.S. Cl. ..... 463/9

(58) Field of Classification Search ..... 463/9–12
See application file for complete search history.

(56) References Cited

U.S. PATENT DOCUMENTS 4,716,529 A * 12/1987 Nakayama ..... 463/14
5,970,143 A * 10/1999 Schneier et al. ..... 713/181
6,224,486 B1 * 5/2001 Walker et al. ..... 463/42
6,648,760 B1 * 11/2003 Nicastro ..... 463/23

FOREIGN PATENT DOCUMENTS

JP 2004-261236 9/2004

* cited by examiner

*Primary Examiner* — Brook Kebede
(74) *Attorney, Agent, or Firm* — Dickstein Shapiro LLP

(57) ABSTRACT

A game system for executing a competition game in which a plurality of players compete. The game system comprises a competition score storing unit; a handicap information storing unit; a matching control unit; a rank deciding unit; a handicap selecting unit; a handicap deciding unit; and a handicap setting unit. The game system allows players of different levels to enjoy a game together.

12 Claims, 38 Drawing Sheets

FIG. 4

100

[MEMBERSHIP CARD DATA TABLE]

| ITEM | CONTENTS |
|---|---|
| STORE ID | |
| USER ID | |
| NAME | |
| SELECTED CHARACTER | |
| NICKNAME | |
| | |
| 01 NATURAL SCIENCE CATEGORY LEVEL | |
| 02 LANGUAGE/LITERATURE CATEGORY LEVEL | |
| 03 HISTORY/GEOMETRY/SOCIETY CATEGORY LEVEL | |
| 04 ENTERTAINMENT CATEGORY LEVEL | |
| 05 COMICS/ANIMATIONS/GAME CATEGORY LEVEL | |
| 06 SPORTS CATEGORY LEVEL | |
| 07 FASHION/GOURMET CATEGORY LEVEL | |
| 08 HOBBIES/MISCELLANEOUS KNOWLEDGE CATEGORY LEVEL | |
| | |
| PLAY HISTORY VS. PLAYER 1 | ○○WINS ××LOSSES |
| PLAY HISTORY VS. PLAYER 2 | ○○WINS ××LOSSES |
| PLAY HISTORY VS. PLAYER 3 | ○○WINS ××LOSSES |
| PLAY HISTORY VS. PLAYER 4 | ○○WINS ××LOSSES |
| PLAY HISTORY VS. PLAYER 5 | ○○WINS ××LOSSES |
| PLAY HISTORY VS. PLAYER 6 | ○○WINS ××LOSSES |
| PLAY HISTORY VS. PLAYER 7 | ○○WINS ××LOSSES |
| PLAY HISTORY VS. PLAYER 8 | ○○WINS ××LOSSES |
| | |
| | |

FIG. 5A

110

[PLAYER DATA TABLE]

| ITEM | CONTENTS |
|---|---|
| STORE ID | |
| USER ID | |
| NAME | |
| SELECTED CHARACTER | |
| NICKNAME | |
| | |
| 01 NATURAL SCIENCE CATEGORY LEVEL | |
| 02 LANGUAGE/LITERATURE CATEGORY LEVEL | |
| 03 HISTORY/GEOMETRY/SOCIETY CATEGORY LEVEL | |
| 04 ENTERTAINMENT CATEGORY LEVEL | |
| 05 COMICS/ANIMATIONS/GAME CATEGORY LEVEL | |
| 06 SPORTS CATEGORY LEVEL | |
| 07 FASHION/GOURMET CATEGORY LEVEL | |
| 08 HOBBIES/MISCELLANEOUS KNOWLEDGE CATEGORY LEVEL | |
| | |
| PLAY HISTORY VS. PLAYER 1 | ○○WINS ××LOSSES |
| PLAY HISTORY VS. PLAYER 2 | ○○WINS ××LOSSES |
| PLAY HISTORY VS. PLAYER 3 | ○○WINS ××LOSSES |
| PLAY HISTORY VS. PLAYER 4 | ○○WINS ××LOSSES |
| PLAY HISTORY VS. PLAYER 5 | ○○WINS ××LOSSES |
| PLAY HISTORY VS. PLAYER 6 | ○○WINS ××LOSSES |
| PLAY HISTORY VS. PLAYER 7 | ○○WINS ××LOSSES |
| PLAY HISTORY VS. PLAYER 8 | ○○WINS ××LOSSES |
| | |
| | |
| | |
| | |
| | |
| | |

FIG. 5B

120

[CPU PLAYER DATA TABLE]

| ITEM | CONTENTS |
|---|---|
| STORE ID | |
| USER ID | |
| NAME | |
| SELECTED CHARACTER | |
| NICKNAME | |
| | |
| 01 NATURAL SCIENCE CATEGORY LEVEL | |
| 02 LANGUAGE/LITERATURE CATEGORY LEVEL | |
| 03 HISTORY/GEOMETRY/SOCIETY CATEGORY LEVEL | |
| 04 ENTERTAINMENT CATEGORY LEVEL | |
| 05 COMICS/ ANIMATIONS/GAME CATEGORY LEVEL | |
| 06 SPORTS CATEGORY LEVEL | |
| 07 FASHION/GOURMET CATEGORY LEVEL | |
| 08 HOBBIES/MISCELLANEOUS KNOWLEDGE CATEGORY LEVEL | |
| | |
| PLAY HISTORY VS. PLAYER 1 | ○○WINS ××LOSSES |
| PLAY HISTORY VS. PLAYER 2 | ○○WINS ××LOSSES |
| PLAY HISTORY VS. PLAYER 3 | ○○WINS ××LOSSES |
| PLAY HISTORY VS. PLAYER 4 | ○○WINS ××LOSSES |
| PLAY HISTORY VS. PLAYER 5 | ○○WINS ××LOSSES |
| PLAY HISTORY VS. PLAYER 6 | ○○WINS ××LOSSES |
| ····· | ····· |
| PLAY HISTORY VS. PLAYER n | ○○WINS ××LOSSES |
| | |
| | |
| | |
| | |
| | |
| | |

FIG. 6A

130

[PLAYER DATA TABLE]

| ITEM | CONTENTS |
|---|---|
| STORE ID | |
| USER ID | |
| NAME | |
| SELECTED CHARACTER | |
| NICKNAME | |
| | |
| 01 NATURAL SCIENCE CATEGORY LEVEL | |
| 02 LANGUAGE/LITERATURE CATEGORY LEVEL | |
| 03 HISTORY/GEOMETRY/SOCIETY CATEGORY LEVEL | |
| 04 ENTERTAINMENT CATEGORY LEVEL | |
| 05 COMICS/ANIMATIONS/GAME CATEGORY LEVEL | |
| 06 SPORTS CATEGORY LEVEL | |
| 07 FASHION/GOURMET CATEGORY LEVEL | |
| 08 HOBBIES/MISCELLANEOUS KNOWLEDGE CATEGORY LEVEL | |
| | |
| PLAY HISTORY VS. PLAYER 1 | ○○WINS ××LOSSES |
| PLAY HISTORY VS. PLAYER 2 | ○○WINS ××LOSSES |
| PLAY HISTORY VS. PLAYER 3 | ○○WINS ××LOSSES |
| PLAY HISTORY VS. PLAYER 4 | ○○WINS ××LOSSES |
| PLAY HISTORY VS. PLAYER 5 | ○○WINS ××LOSSES |
| PLAY HISTORY VS. PLAYER 6 | ○○WINS ××LOSSES |
| PLAY HISTORY VS. PLAYER 7 | ○○WINS ××LOSSES |
| PLAY HISTORY VS. PLAYER 8 | ○○WINS ××LOSSES |
| | |
| RANKS (NATURAL ENEMY, HIGHER RANK, EVEN, LOWER RANK, EASY MARK) | |
| | |
| HANDICAPS (NONE, CATEGORIES, POINTS) | |
| | |
| | |

FIG. 6B

140

[COMPETE PLAYER DATA TABLE]

| ITEM | CONTENTS |
|---|---|
| STORE ID | |
| USER ID | |
| NAME | |
| SELECTED CHARACTER | |
| NICKNAME | |
| | |
| 01 NATURAL SCIENCE CATEGORY LEVEL | |
| 02 LANGUAGE/LITERATURE CATEGORY LEVEL | |
| 03 HISTORY/GEOMETRY/SOCIETY CATEGORY LEVEL | |
| 04 ENTERTAINMENT CATEGORY LEVEL | |
| 05 COMICS/ANIMATIONS/GAME CATEGORY LEVEL | |
| 06 SPORTS CATEGORY LEVEL | |
| 07 FASHION/GOURMET CATEGORY LEVEL | |
| 08 HOBBIES/MISCELLANEOUS KNOWLEDGE CATEGORY LEVEL | |
| | |
| PLAY HISTORY VS. PLAYER 1 | ○○WINS ××LOSSES |
| PLAY HISTORY VS. PLAYER 2 | ○○WINS ××LOSSES |
| PLAY HISTORY VS. PLAYER 3 | ○○WINS ××LOSSES |
| PLAY HISTORY VS. PLAYER 4 | ○○WINS ××LOSSES |
| PLAY HISTORY VS. PLAYER 5 | ○○WINS ××LOSSES |
| PLAY HISTORY VS. PLAYER 6 | ○○WINS ××LOSSES |
| PLAY HISTORY VS. PLAYER 7 | ○○WINS ××LOSSES |
| PLAY HISTORY VS. PLAYER 8 | ○○WINS ××LOSSES |
| | |
| RANKS (NATURAL ENEMY, HIGHER RANK, EVEN, LOWER RANK, EASY MARK) | |
| | |
| HANDICAPS (NONE, CATEGORIES, POINTS) | |
| | |
| | |

FIG. 7

150

[QUESTION DATABASE]

| CATEGORY | QUESTION |
|---|---|
| 01 NATURAL SCIENCE CATEGORY LEVEL | |
| | |
| | |
| | |
| 02 LANGUAGE/LITERATURE CATEGORY LEVEL | |
| | |
| | |
| | |
| 03 HISTORY/GEOMETRY/SOCIETY CATEGORY LEVEL | |
| | |
| | |
| | |
| 04 ENTERTAINMENT CATEGORY LEVEL | |
| | |
| | |
| | |
| 05 COMICS/ANIMATIONS/GAME CATEGORY LEVEL | |
| | |
| | |
| | |
| 06 SPORTS CATEGORY LEVEL | |
| | |
| | |
| | |
| 07 FASHION/GOURMET CATEGORY LEVEL | |
| | |
| | |
| | |
| 08 HOBBIES/MISCELLANEOUS KNOWLEDGE CATEGORY LEVEL | |
| | |
| | |
| | |

FIG. 11A

| No. | CONTENTS | INDICATION POSITIONS | INDICATION CONDITIONS |
|---|---|---|---|
| 0 | NATURAL ENEMY | SIDE OF COMPETITOR | LOST 5 OR MORE OF A TOTAL OF 10 OR MORE COMPETITIONS |
| 1 | HIGHER RANK | SIDE OF COMPETITOR | LOST COMPETITIONS ARE MORE THAN WON COMPETITIONS |
| 2 | EVEN | CENTER | LOST AND WON COMPETITIONS ARE EVEN |
| 3 | LOWER RANK | SIDE OF COMPETITOR | WON COMPETITIONS ARE MORE THAN LOST COMPETITIONS |
| 4 | EASY MARK | SIDE OF COMPETITOR | WON 5 OR MORE OF A TOTAL OF 10 OR MORE COMPETITIONS |
| 5 | RIVAL | CENTER | DIFFERENCE BETWEEN WIND AND LOSSES OF A TOTAL 5 OR MORE COMPETITIONS IS 0 |
| 6 | DESTINED RIVAL | CENTER | DIFFERENCE BETWEEN WIND AND LOSSES OF A TOTAL 20 OR MORE COMPETITIONS IS 0 |

FIG. 11B

| No. | CONTENTS | INDICATION POSITIONS |
|---|---|---|
| 0 | FIRST COMPETITION | FIRST COMPETITION |
| 1 | REVENGE MATCH | LOST IN PREVIOUS COMPETITION |
| 2 | CHALLENGE | WON IN PREVIOUS COMPETITION |
| 3 | DESTINED CONFRONTATION | DREW IN PREVIOUS COMPETITION |
| 4 | TWO MATER CONFRONTATION | RIVAL IN RANK AND DESTINED RIVAL |
| 5 | | |
| 6 | | |

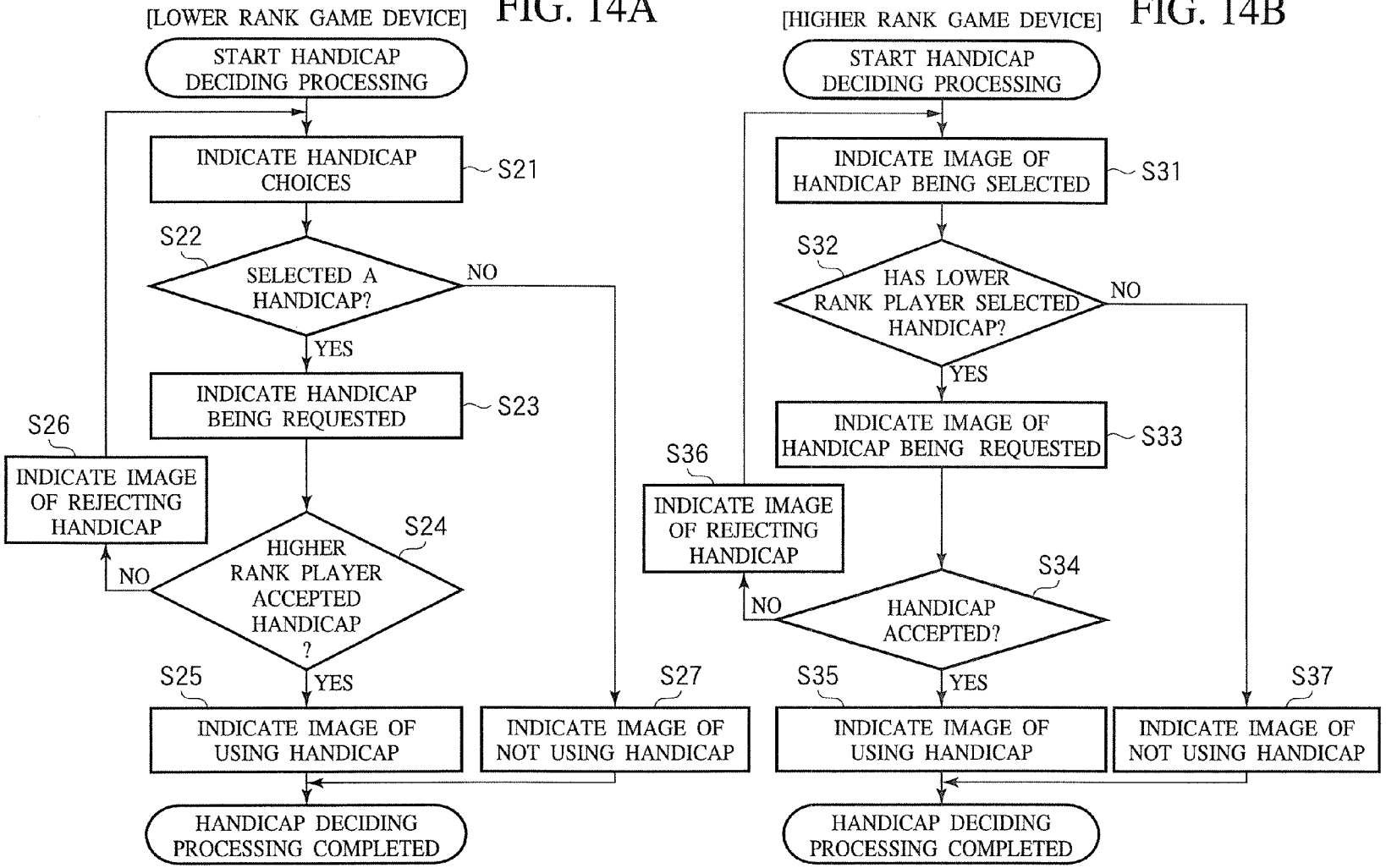
FIG. 14A
[LOWER RANK GAME DEVICE]
START HANDICAP DECIDING PROCESSING
S21
INDICATE HANDICAP CHOICES
S22
SELECTED A HANDICAP?
NO
YES
S23
INDICATE HANDICAP BEING REQUESTED
S24
HIGHER RANK PLAYER ACCEPTED HANDICAP ?
NO
YES
S25
INDICATE IMAGE OF USING HANDICAP
S26
INDICATE IMAGE OF REJECTING HANDICAP
S27
INDICATE IMAGE OF NOT USING HANDICAP
HANDICAP DECIDING PROCESSING COMPLETED
FIG. 14B
[HIGHER RANK GAME DEVICE]
START HANDICAP DECIDING PROCESSING
S31
INDICATE IMAGE OF HANDICAP BEING SELECTED
S32
HAS LOWER RANK PLAYER SELECTED HANDICAP?
NO
YES
S33
INDICATE IMAGE OF HANDICAP BEING REQUESTED
S34
HANDICAP ACCEPTED?
NO
YES
S35
INDICATE IMAGE OF USING HANDICAP
S36
INDICATE IMAGE OF REJECTING HANDICAP
S37
INDICATE IMAGE OF NOT USING HANDICAP
HANDICAP DECIDING PROCESSING COMPLETED

FIG. 15

| No. | HANDICAP | WEIGHT | CONTENTS | INDICATION CONDITION |
|---|---|---|---|---|
| 0 | REQUEST NO HANDICAP | – | WITHOUT HANDICAP | – |
| 1 | DON'T SELECT CATEGORY IN ROUND 1 ALONE! | LIGHT | HIGHER RANK CANNOT SELECT CATEGORIES IN ROUND 1 | COMPETITOR IS HIGHER RANK |
| 2 | DON'T SELECT CATEGORY IN ALL ROUNDS! | LIGHT | HIGHER RANK CANNOT SELECT CATEGORIES IN ALL ROUNDS | COMPETITOR IS NATURAL ENEMY |
| 3 | LET ME START WITH +10 PTS IN ROUND 1 ALONE! | MEDIUM | LOWER RANK STARTS WITH +10 PTS IN ROUND 1 | COMPETITOR IS HIGHER RANK |
| 4 | LET ME START WITH +10 PTS IN ALL ROUNDS! | HEAVY | LOWER RANK STARTS WITH +10 PTS IN ALL ROUNDS | COMPETITOR IS HIGHER RANK |
| 5 | LET ME START WITH +20 PTS IN ROUND 1 ALONE! | MEDIUM | LOWER RANK STARTS WITH +20 PTS IN ROUND 1 | COMPETITOR IS NATURAL ENEMY |
| 6 | LET ME START WITH +20 PTS IN ALL ROUNDS! | HEAVY | LOWER RANK STARTS WITH +20 PTS IN ALL ROUNDS | COMPETITOR IS NATURAL ENEMY |

FIG. 16A1
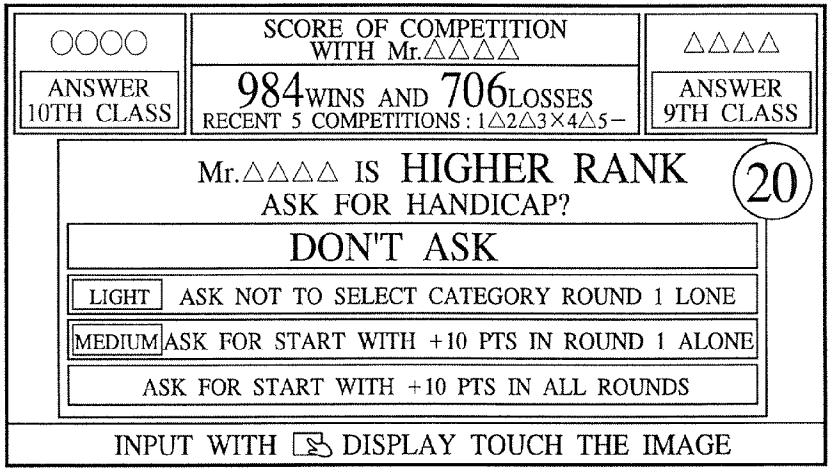
FIG. 16A2
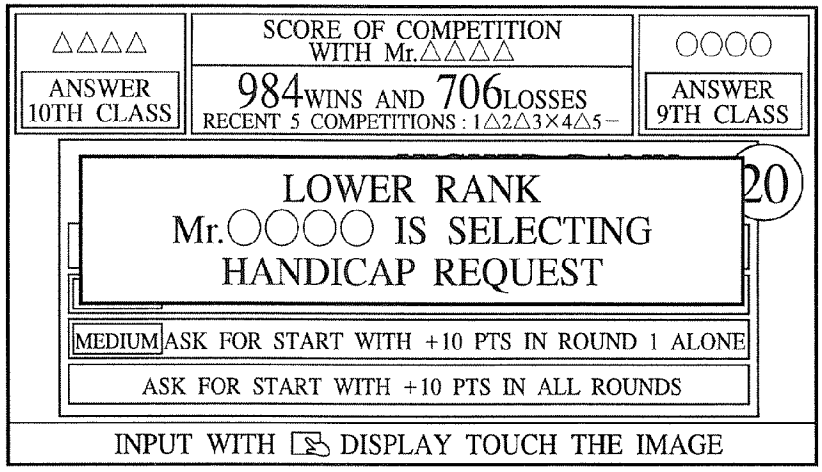
FIG. 16B1
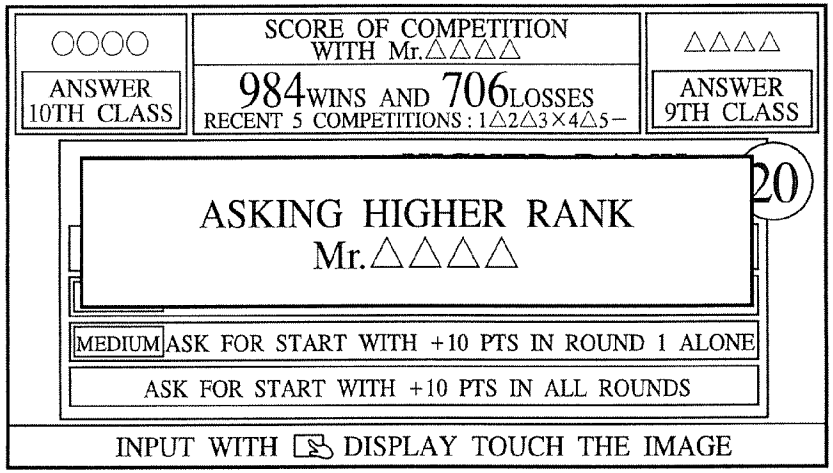
FIG. 16B2
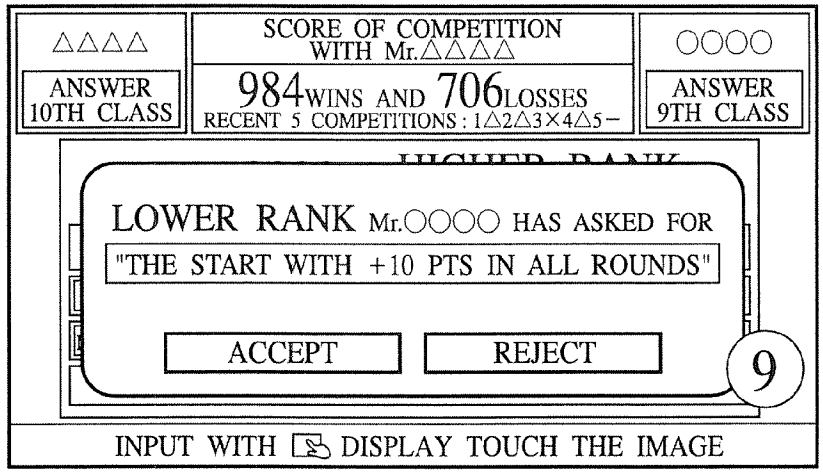

FIG. 17A1
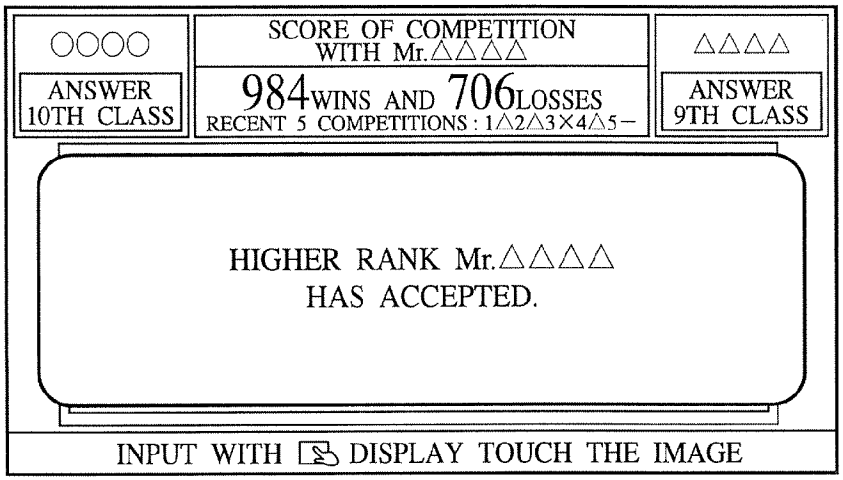
FIG. 17A2
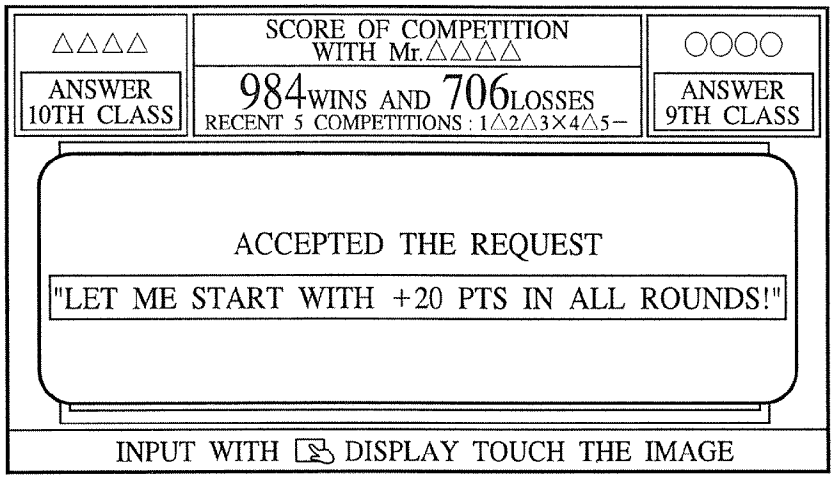
FIG. 17B1
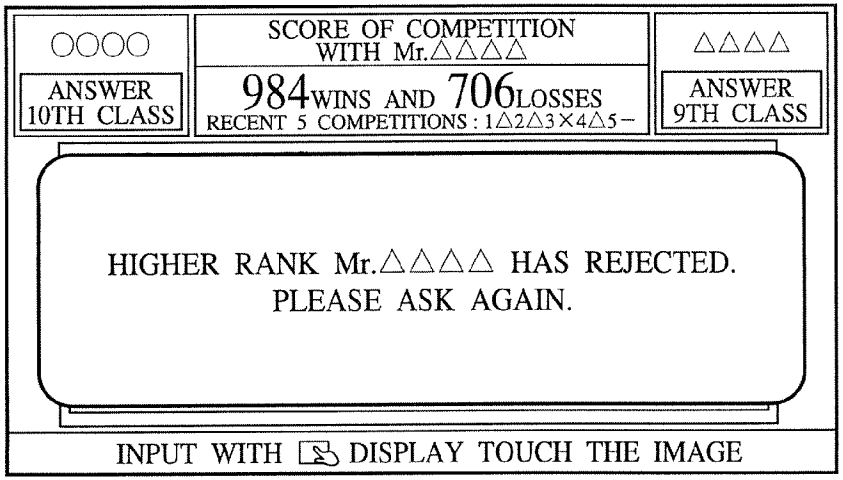
FIG. 17B2
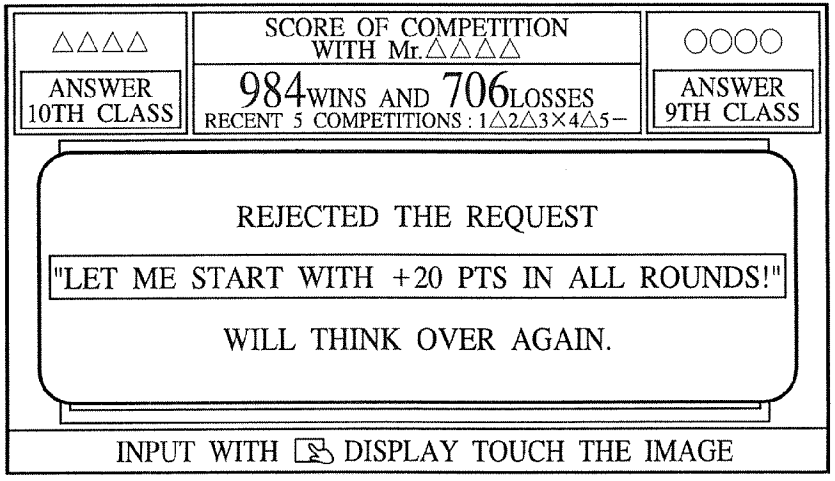

FIG. 18A1
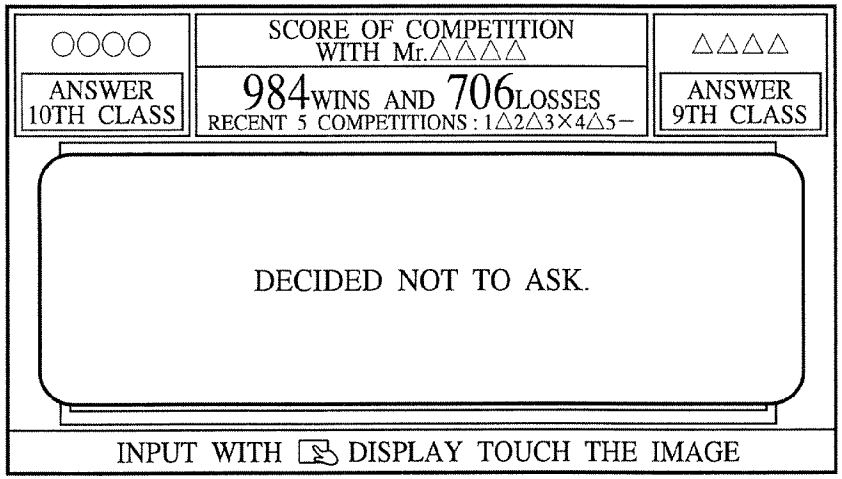
FIG. 18A2
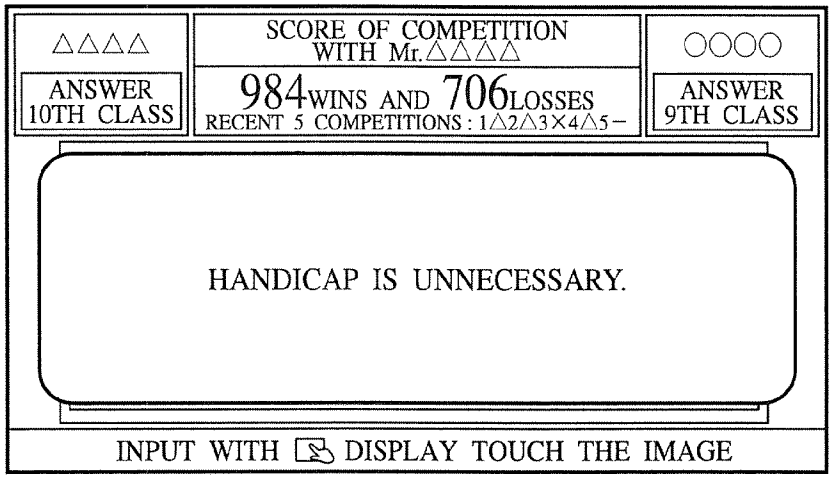

OWN CATEGORY BALLS

COMPETITOR CATEGORY BALLS

OTHER BALLS

FIG. 31A

[QUESTION CONSTITUTION TABLE]

| QUESTION | CATEGORY | CHARACTERISTICS |
|---|---|---|
| 1ST QUESTION | | |
| 2ND QUESTION | | |
| 3RD QUESTION | | |
| 4TH QUESTION | | |
| 5TH QUESTION | | |
| 6TH QUESTION | | |
| 7TH QUESTION | | |
| 8TH QUESTION | | |
| 9TH QUESTION | | |
| 10TH QUESTION | | |
| 11TH QUESTION | | |
| 12TH QUESTION | | |
| | | |
| | | |
| | | |

160

FIG. 31B

[QUESTION CONSTITUTION TABLE]

| QUESTION | CATEGORY | CHARACTERISTICS |
|---|---|---|
| 1ST QUESTION | 07 FASHION/GOURMET CATEGORY | NORMAL |
| 2ND QUESTION | 01 NATURAL SCIENCE CATEGORY | NORMAL |
| 3RD QUESTION | 07 FASHION/GOURMET CATEGORY | NORMAL |
| 4TH QUESTION | 01 NATURAL SCIENCE CATEGORY | NORMAL |
| 5TH QUESTION | 07 FASHION/GOURMET CATEGORY | NORMAL |
| 6TH QUESTION | 01 NATURAL SCIENCE CATEGORY | NORMAL |
| 7TH QUESTION | NON CATEGORY | 1.5 TIMES SCORE |
| 8TH QUESTION | NON CATEGORY | 2.0 TIMES SCORE |
| 9TH QUESTION | NON CATEGORY | NORMAL |
| 10TH QUESTION | NON CATEGORY | 1.5 TIMES SCORE |
| 11TH QUESTION | NON CATEGORY | NORMAL |
| 12TH QUESTION | NON CATEGORY | 2.0 TIMES SCORE |
| | | |
| | | |
| | | |

160

GAME SYSTEM AND GAME CONTROL METHOD

BACKGROUND OF THE INVENTION

The present invention relates to a game system and a game control method, more specifically, a gate system and a game control method for players competing in quizzes, etc.

As a game system for a plurality of uses competing by means of game systems, etc. installed in amusement facilities, etc., recently a game system for players in nationwide amusement facilities participating by connecting the game systems by internets is proposed.

As such a game system is known the game system as disclosed in Patent Reference 1 in which a number of players all over a country take part in to compete in answering questions in a quiz. In this game system, a number of players participate at the same time in one quiz game called the nationwide online competition so as answer questions by getting answer rights by quick pushes, etc. and compete in their points based on the correctness of their answers.

In this game system, however, a player can get no answer right and cannot easily enjoy the game, when the levels of the other players are too high. Oppositely, a player becomes less intensive to the game and cannot easily enjoy the game, when the levels of the other players are too low, Patent Reference 1 is Specification of Japanese Patent Application Unexamined Publication No. 2004-261236.

SUMMARY OF THE INVENTION

An object of the present invention is to provide a game system and a game control method which allow players of different levels to enjoy the game.

The game system according to one aspect of the present invention is characterized in that the game system for executing a competition game in which a plurality of players compete comprising: a competition score storing unit which stores competition scores of competitions of one player with the other players with respect to each of the other players; a handicap information storing unit which stores handicap information of a plurality of handicaps which vary a difficulty of winning the competition game for said one payer vs. a competitor; a matching control unit which matches one of the other players as a competitor with said one player, based on a competition request input of said one player; a rank deciding unit which reads the competition score of said competitor from the competition score storing unit, and, based on the competition scores, judges whether the rank of said one player is higher or lower with respect to said competitor and the rank difference between said one player and said competitor; a handicap selecting unit which, based on the rank difference, decides a plural of handicaps which can be set in the competition game, presents the decided plural handicaps to the lower rank player in said one player and said competitor, and permits the lower rank player to select one from the presented plural handicaps; a handicap deciding unit which presents to the higher rank player in said one player and said competitor the handicap selected by the lower rank player, and permits the higher rank player to decide whether or not the higher rank player accepts the selected handicap; and a handicap setting unit which reads the handicap information corresponding to the handicap decided by the handicap deciding unit from the handicap information storing unit and, based on the handicap information, sets the handicap of the competition game.

In the game system described above, it is possible that the handicaps decided based on the rank difference by the handicap selecting unit contain a handicap that there is no handicap.

In the game system described above, it is possible that the matching control unit presents to said one player the information of said one of the other players to be matched with said one player to make said one player select whether or not the matching with said one of the other players is acceptable, and, when said one player accepts the matching with said one of the other players, sets said one of the other players as the competitor.

In the game system described above, it is possible that the matching control unit further comprises a preferential matching unit which, when said one of the other players is matched with said one player, preferentially matches the player who has been recorded in said competition score of said one player.

In the game system described above, it is possible that the game system further comprises a match title indicating unit which indicates, in a display unit, a match title of the game which is decided based on the competition score of said competitor of said one player.

In the game system described above, it is possible that the game is a quiz game in which a plurality of players answer questions of a plurality of categories, a question constitution of the quiz game is decided based on categories selected by said plural players, and the handicap decided based on the rank differences by the handicap selecting unit contains a handicap that the higher rank player is prohibited from selecting categories.

The game system according to one aspect of the present invention is characterized in that the game system comprises: a plurality of game devices each having an operation unit, a display unit, a storing unit, and a control unit, the game device being operated by a plurality of players; and a control device having a storing unit and a control unit, the control device, the game system executing a competition game by a plural of players, at least the storing unit of the control device storing competition scores of competitions of one player with the other players with respect to each of the other players, the control unit of the control device matching a plural of players to be competed, and deciding a lower rank player and a higher rank player in the matched plural players based on the competition scores between the matched plural players, the control unit of the game device operated by the lower rank player selecting the handicap in which the higher rank player is placed at a disadvantage in the competition game, by operating of the lower rank player, the control unit of the game device operated by the higher rank player presenting to the display unit the handicap selected by the lower rank player, and permitting the higher rank player to decide whether or not the higher rank player accepts the selected handicap.

In the game system described above, it is possible that the control unit of the game device operated by the lower rank player presents to the display unit a plural of options for handicaps, and makes the lower rank player select one handicap from the plural of the options for handicaps by operating of the lower rank player.

In the game system, it is possible that the plural of options for handicaps contain a handicap that there is no handicap.

In the game system, it is possible that the control units of the game devices operated by the matched plural players present to the display units the information of the player to be matched to decide whether or not the matching with the player is acceptable, and that the control unit of the control device judges that said matching has been made, when said matching is accepted by the matched plural players.

In the game system, it is possible that the control units of the game devices operated by the matched plural players present to the display units a match title of the game which is decided based on the competition score of said competitor of said one player.

In the game system, it is possible that the game is a quiz game in which a plurality of players answer questions of a plurality of categories, a question constitution of the quiz game is decided based on categories selected by said plural players, and the handicap decided based on the rank differences by the handicap selecting unit contains a handicap that the higher rank player is prohibited from selecting categories.

According to the present invention, at least the storing unit of the control device storing competition scores of competitions of one player with the other players with respect to each of the other players, the control unit of the control device matching a plural of players to be competed, and deciding a lower rank player and a higher rank player in the matched plural players based on the competition scores between the matched plural players, the control unit of the game device operated by the lower rank player selecting the handicap in which the higher rank player is placed at a disadvantage in the competition game, by operating of the lower rank player, the control unit of the game device operated by the higher rank player presenting to the display unit the handicap selected by the lower rank player, and permitting the higher rank player to decide whether or not the higher rank player accepts the selected handicap, thereby the game can be enjoyed between players of even different levels.

BRIEF DESCRIPTION OF THE DRAWINGS

FIG. 4 is a view illustrating the membership card data table of the game system according to the present embodiment of the present invention.

FIG. 5 is views illustrating the player data tables stored in the server of the game system according to the embodiment of the present invention.

FIG. 6 is views illustrating the player data tables stored in the game device of the game system according to the present embodiment of the present invention.

FIG. 7 is a view illustrating the question data base stored in the game device of the game system according to the present embodiment.

FIG. 11 is views illustrating a list of ranks and a list of match titles in the matching processing of the embodiment of the present invention.

FIG. 14 is flow charts of the handicap deciding processing of the embodiment of the present invention.

FIG. 15 is a view illustrating a list of handicaps of the handicap deciding processing of the embodiment of the present invention.

FIG. 16 is views illustrating the game images for introducing competitors in the matching processing of the embodiment of the present invention (Part 1).

FIG. 17 is views illustrating the game images for introducing competitors in the matching processing of the embodiment of the present invention (Part 2).

FIG. 18 is views illustrating the game images for introducing competitors in the matching processing of the embodiment of the present invention (Part 3).

FIG. 31 is views illustrating the question constitution tables of the competition game processing of the embodiment of the present invention.

DETAILED DESCRIPTION OF THE INVENTION

[A First Embodiment]

The game system according to one embodiment of the present invention will be explained with reference to the drawings.

The game system according to the present embodiment comprises game devices installed in nationwide amusement facilities connected to one another by internets, so that players even located remote from one another can make competitive games, such as quizzes, etc.

(Summary of the Game System)

Figure 1:
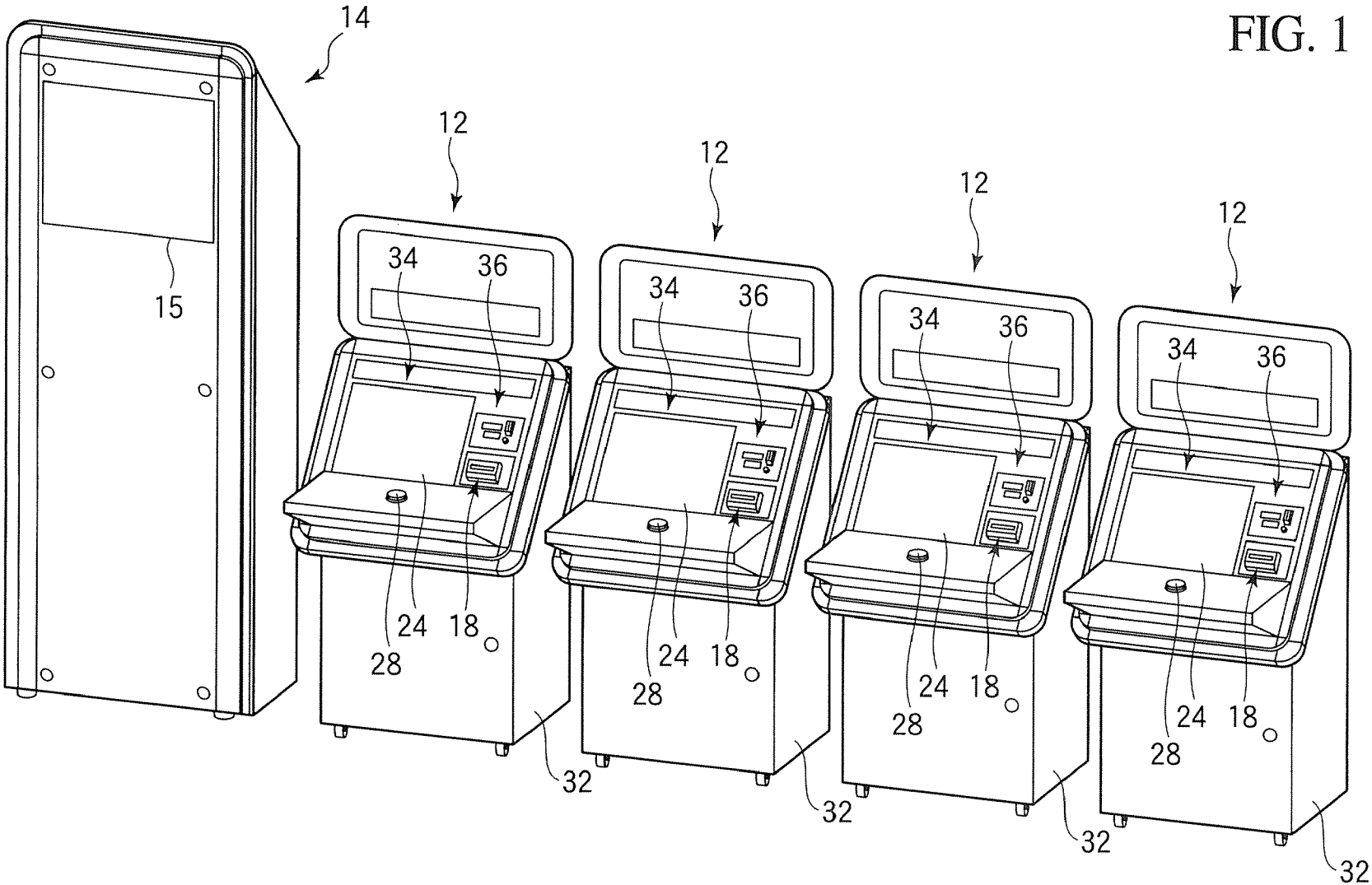
FIG. 1 is a view illustrating the appearance of the game system according to one embodiment of the present invention.
Figure 2:
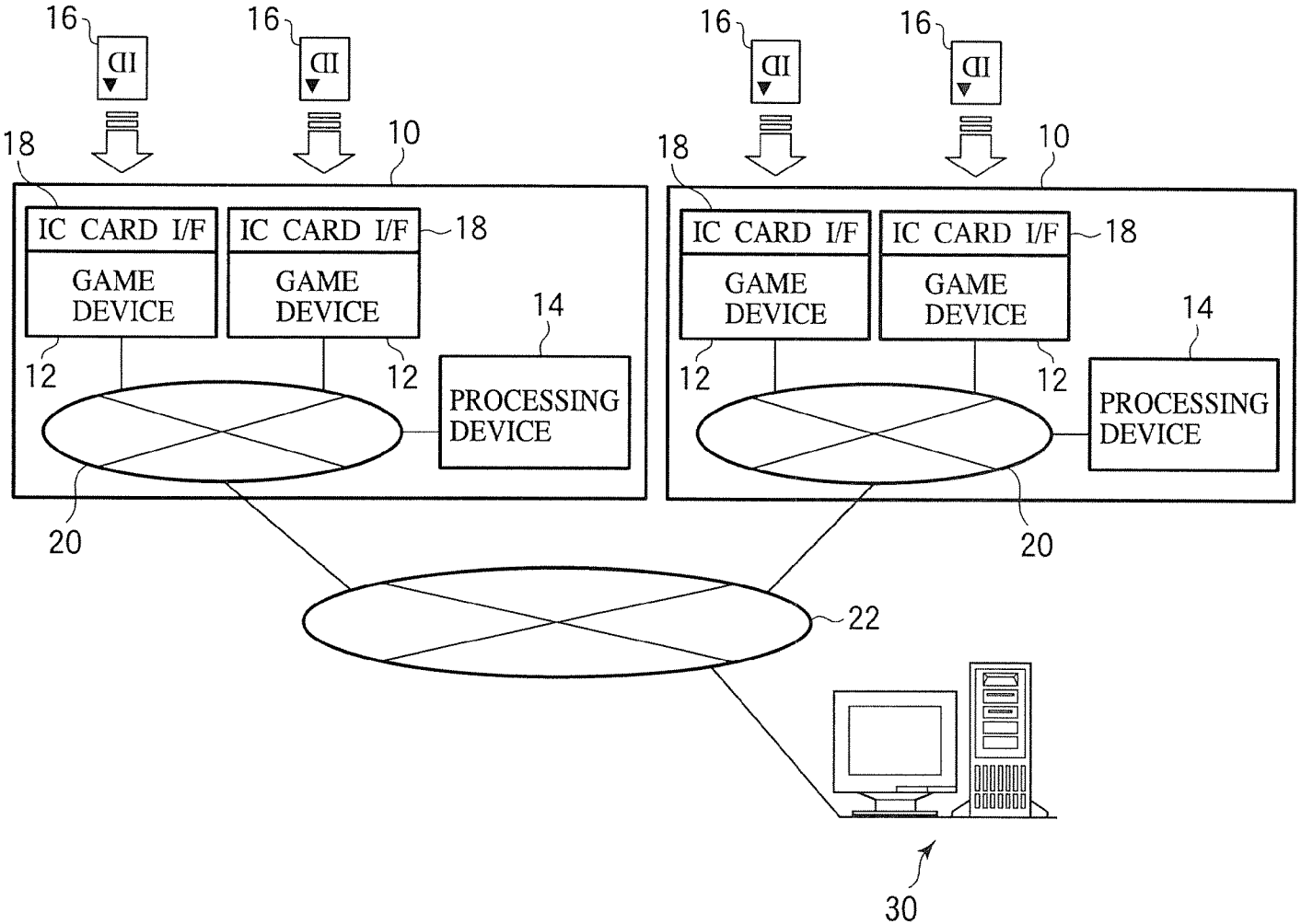
FIG. 2 is a block diagram of the game system according to the embodiment of the preset invention.

The game system according to the present embodiment will be explained with reference to FIGS. 1 and 2. FIG. 1 is a perspective view illustrating the appearance of the game devices of the game system according to the present embodiment. FIG. 2 is a block diagram of the game system according to the preset embodiment.

Amusement facilities 10 are present all over, e.g., Japan at various locations. In each amusement facility 10, a plurality of game devices 12 for playing the game are installed. In each amusement facility 10, in addition to the game devices 12, a processing system 14 for the display of the game content, and others is provided. The spectators can look at the game with a display monitor 15 of the processing system 14 if the processing system 14 is provided.

Each player inserts coins into the gate device 12 to play a quiz game. The game device 12 has an IC card I/F (interface) for reading a membership card 16 which is an IC card. A specific ID number is indicated on the membership card 16.

Each game device 12 is connected to a LAN 20 in the amusement facility 10 and can communicate mutually with the other game devices 12 in the amusement facility 10. The LAN of the amusement facility 10 is connected to an internet 22 and can communicate mutually with the game devices of the other amusement facilities 10. Thus, a common quiz game can be played with arbitrary game devices which are even remotely located.

A player who has come to the amusement facility 10 sits at a game device, inserts coins and operates execution button 28 to thereby play the quiz game with other players.

A server 30 is connected to the internet 22. The server 30 includes a control means (not illustrated) and a memory means (not illustrated). The control means controls the game devices 12, and the memory means collects play data of games, such as quiz games, etc., executed by the game devices 12 via the internet 22, and stores and controls the play data.

The memory means of the server 30 stores game levels and the game history of each player. The game levels are given corresponding to competition results.

(Constitution of Game Device)

Figure 3:
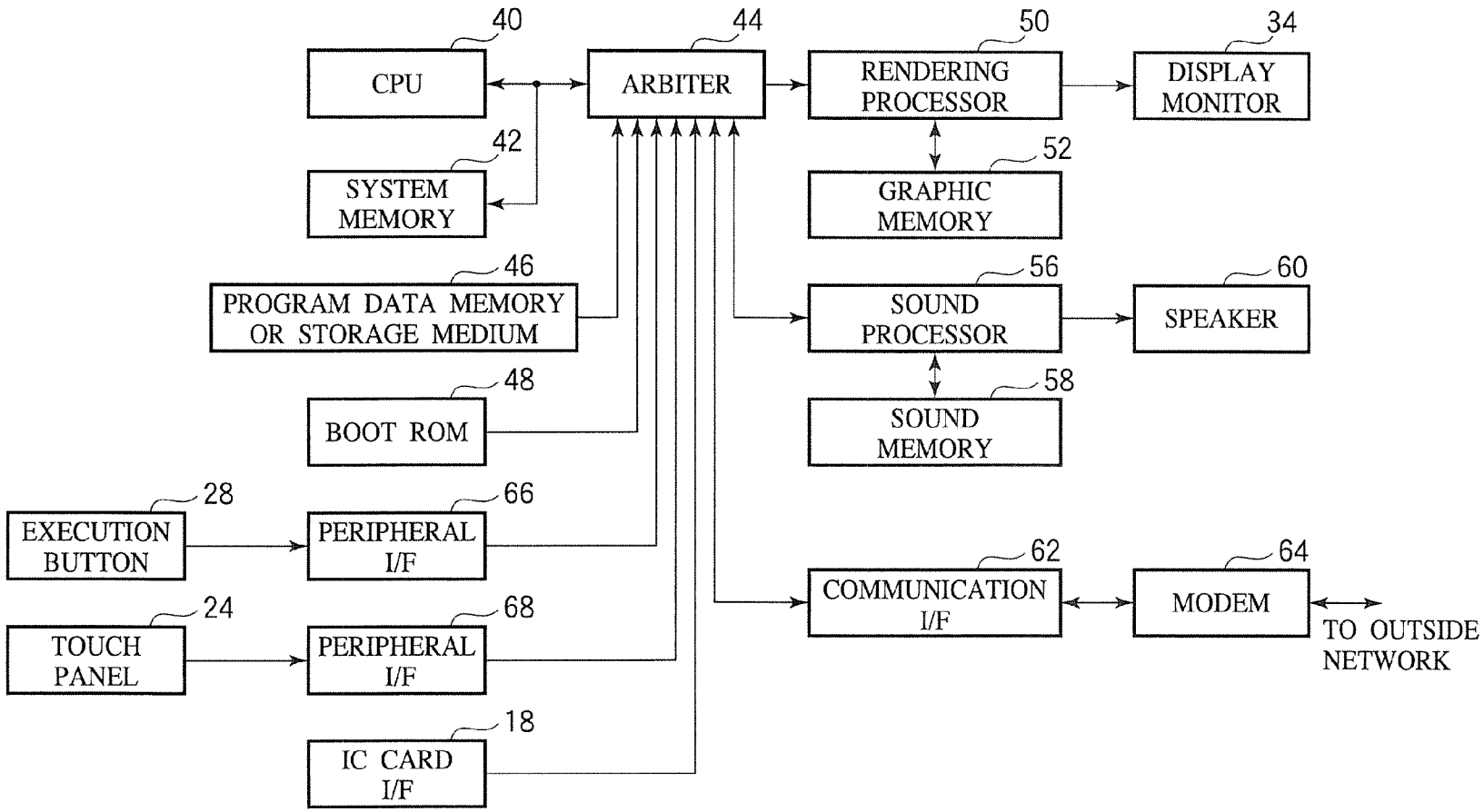
FIG. 3 is a block diagram of the game devices of the game system according to the embodiment of the present invention.

The constitution of the game devices of the game system according to the present embodiment will be explained with reference to FIG. 3. FIG. 3 is a block diagram of the game device of the present embodiment.

As illustrated in FIG. 1, in the casing 32 of each game device 12, a display monitor 34 for displaying game contents, a touch panel 24 disposed on the display monitor 34, for a player operating a game, a coin slot 36 for a player to insert coins into, the IC card I/F 18 for reading a membership card 16, and the execution button 28 for execution operations are provided.

As illustrated in FIG. 3, to each game device 12, a CPU 40 which executes a game program, generally controls the system and makes the coordinate computation, etc. for the image display, and a system memory (RAM) 42 used as a buffer memory which stores programs and data for the CPU 40 to make the processing are commonly connected and are connected to a bus arbiter 44. The bus arbiter 44 controls the program and data flow to machines connected to the respective blocks of each game device 12 and the outside.

To the bus arbiter 44, a program data memory 46 storing game programs and data (including video data and music data) or a memory medium (including an optical disc, optical disc drive, etc. for driving CD-ROM, etc. which are game storage mediums), and a BOOTROM 48 storing programs and data for actuating the game device are connected via bus lines.

Via the bus arbiter 33, a rendering processor 50 which reproduces video (MOVIE) data read from the program data memory or the memory medium 46 or producing images to be displayed in accordance with operations of the player or a game progress, a graphic memory 52 storing graphic data, etc. necessary for the rendering processor 50 to produce images are connected. The vide signals outputted from the rendering processor 50 are converted from digital signal to analog signals by a video DAC (not illustrated) to be displayed on the display monitor 34.

Via the bus arbiter 44, a sound processor 56 which reproduces music data read from the program data memory or the memory medium 46 or produces effect sounds and sounds in accordance with operations of the player or game progresses, and a sound memory 58 storing sound data, etc. for the sound processor 56 to produce effect sounds and sounds are connected. The sound signals outputted from the sound processor 56 are converted from digital signals to analog signals by an audio DAC (not illustrated) to be outputted from the speaker 60.

To the bus arbiter 44, a communication interface 62 is connected. The communication interface 62 is connected to an outside network, such as telephone circuit or others, via a modem 64. The game devices 12 are connected, by the modem 64, to the internet via the telephone circuit to thereby communicate with the other game devices 12, the net server 30, etc. The communication interface 62 and the modem 64 use the telephone circuit but may use a terminal adapter (TA) and a rooter using the telephone circuit, a cable modem using the cable television circuit, radio communication means using portable telephones and PHS, optical fiber communication means using optical fibers, and other communication means.

To the bus arbiter 44, the execution button 28 is connected via a peripheral I/F (interface) 66. The execution button 28 is for inputting execution commands of various operations. The peripheral I/F 66 outputs signals for controlling machines connected to the game devices 12 and the outside corresponding to operations of the player.

To the bus arbiter 44, the touch panel 24 is connected via the peripheral I/F 68. The touch panel 24 is for the player to touch to input various operations. The peripheral I/F 68 outputs signals for controlling machines connected to the game device 12 and the outside in accordance with operations of the player. The touch panel 24 functions as a position coordinates obtaining means which obtains coordinate values of a position touched by the finger to produce position coordinates information.

To the bus arbiter 44, the IC card I/F 18 for reading the membership card 16 is connected.

A back-up memory (not illustrated) is connected to the bus arbiter 44, and game scores, etc. are recorded in the back-up memory. The system memory (RAM) may be used as the back-up memory.

The game devices 12 are not essentially game devices installed in stores, such as amusement facilities, game cafes, etc. and can be domestic game devices, personal computers, portable telephones, electronic game machines, electronic devices, such as portable telephones, PDA, etc., and game information processing devices.

(Data Table)

Various game data of the game system according to the present embodiment will be explained with reference to FIGS. 4 to 6.

In the game system according to the present embodiment, a player inserts coins into the game device 12, has the membership card 16 which is the IC card read to thereby participate in a quiz game.

In the memory of the server 30, game data of all registered players, game data of the CPU player prepared on the side of the system in preparation for the absence, etc. of competing players are stored and administered. In a competition, these data are read from the game device 12.

In the memory of each game device 12, the game data of the player using the game device, which has been read from the server 30, and the game data of competing players are stored.

The questions to be used in the game system according to the present embodiment are formed in a question database and are stored in the memory of the sever 30 and in the memory of each game device 12. Thus, even when the server 30 should have a trouble, the game devices 12 themselves can play the game.

(Data Table of Membership Card)

The data table of the membership cards of the game system according to the present embodiment will be explained with reference to FIG. 4.

In the game system according to the present embodiment, a payer has the membership card 16 read to thereby participate in the quiz game. In the IC card, which is the membership card 16, the data table 100 illustrated in FIG. 4 is stored.

The data table 100 of the membership card contains the following columns.

1. "Store ID" column indicating the store information of a store which has issued the membership card.
2. "User ID" column indicating user ID information assigned to the player.
3. "Name" column indicating the name of the player.
4. "Selected Character" column indicating a character the player has selected.
5. "Level" column indicating levels of the respective categories of the game.
6. "Play History" column indicating histories of plays with the other players.

The 5. "Level" column contains the following respective "level" columns for the respective categories.

51. "Natural Science Category Level" column indicating the ability of the player for questions of the natural science.
52. "Language/Literature Categories Level" indicating the ability of the player for questions of the language/literature categories.
53. "Social Science Category Level" column indicating the ability of the player for questions of the history/geometry/society categories.
54. "Entertainments Category Level" indicating the ability of the player for questions of the entertainments.
55. "Comics/Animations/Games Categories Level" column indicating the ability for the player for questions of the entertainments.
56. "Sports Category Level" column indicating the ability of the player for questions of the sports categories.
57. "Fashion/Gourmet Category Level" column indicating the ability of the player for questions of the fashion/Gourmet category.
58. "Hobbies/Miscellaneous knowledge Categories Level" column indicating the ability of the player for questions of the hobbies/Miscellaneous knowledge categories.

The 6. "Player History" column contains "Player History" columns of 8 players as follows.

61. "Play History vs. Player 1" column indicating the score (OO wins XX losses) of the competition with Player 1.
62. "Play History vs. Player 2" column indicating the score (OO wins XX losses) of the competition with Player 1.
63. "Play History vs. Player 1" column indicating the score (OO wins XX losses) of the competition with Player 3.
64. "Play History vs. Player 2" column indicating the score (OO wins XX losses) of the competition with Player 4.
65. "Play History vs. Player 1" column indicating the score (OO wins XX losses) of the competition with Player 5.
66. "Play History vs. Player 2" column indicating the score (OO wins XX losses) of the competition with Player 6.
67. "Play History vs. Player 1" column indicating the score (OO wins XX losses) of the competition with Player 7.
68. "Play History vs. Player 2" column indicating the score (OO wins XX losses) of the competition with Player 8.

(Method of Deciding Category Level of Player)

The method of deciding category level of players will be explained.

In the present embodiment, the levels of a player for the respective question categories are decided basically by the point scoring. When a player correctly answers a quiz question, a point is given to the player. The point to be given differs depending on questions. The characteristics to be described later often add points which are 1.5 times or twice ordinary points.

For example, initially the point is 0, and the level starts with "Level 1". When points are accumulated, the point becomes 10, the level rises "Level 2". Points are further accumulated, and when the point becomes 15 points, the level rises "Level 3"; at 20 points, the level rises "Level 4"; at 2.5 points, the level rises to "Level 5"; at 30 points, the level rises "Level 6"; at 35 points, the level rises to "Level 7"; at 40 points, the level rises "Level 8"; at 45 points, the level rises to "Level 9"; and at 50 points, the level rises to "Level 10". "Level 10" is maximum and is called also "Level MAX".

However, points of only a prescribed number of the most recent questions are accumulated. For example, the level is decided depending on points obtained by the most recent 100 questions. This is to reflect the most recent conditions of the players, because the conditions of the pales vacillate.

In the present embodiment, the levels of a player for the respective question categories are decided basically on the point scoring and not on the correct answer rate. This is because the point scoring can correctly reflect the players' spirits of participating in the game.

The method of deciding the category levels of the players may be other methods different from the above-described deciding method. For example, the category levels of the players may be decided based on their correct answer rate of the questions.

In short, it can be said that the "category level" is "an answer level decided based on an answer level parameter value which varies with correct answers of questions of the corresponding category".

(Player Data Table of Server)

The player data table stored in the server 30 of the game system according to the present embodiment will be explained with reference to FIG. 5.

In the memory of the server 30, a player data table 110 of registered players, and a CPU player data table 120 of the CPU player prepared on the side of the system are stored and administered The player data table 110 is illustrated in FIG. 5A. The player data table 110 contains the following columns.

1. "Store ID" column indicating the store information of a store which has issued a membership card.
2. "User ID" column indicating the user ID information assigned to the player.
3. "Name" column indicating the name of the player.
4. "Selected Character" column indicating a character selected by the player.
5. "Level" column indicating the levels of the respective categories of the game.
6. "Play History" column indicating the play histories of plays with other players.

The 5. "Level" column contains the following "Level" columns of the respective categories.

51. "Natural Science Category Level" column indicating the ability of the player for questions of the natural science category.
52. "Language/Literature Category Level" column indicating the ability of the player for questions of the language/literature categories.
53. "Social Science Category Level" column indicating the ability of the player for questions of the history/Geometry/society categories.
54. "Entertainments Category Level" column indicating the ability of the player for questions of the entertainments.
55. "Comics/Animations/Games Category Level" column indicating the ability of the player for questions of the entertainments.
56. "Sports Category Level" column indicating the ability of the player for questions of the sports categories.
57. "Fashion/Gourmet Category Level" column indicating the ability of the player for questions of the Fashion/Gourmet category.
58. "Hobbies/Miscellaneous knowledge Category Level" column indicating the ability of the player for questions of the hobbies/Miscellaneous knowledge category.

The 6. "Player History" column contains "Player History" columns of 8 players.

The CPU player data table 120 is illustrated in FIG. 5B. The CPU player data table 120 contains the following columns.

1. "Store ID" column indicating the store information of a store which has issued a membership card.
2. "User ID" column indicating the user ID information assigned to the player.
3. "Name" column indicating the name of the player.
4. "Selected Character" column indicating a character selected by the player.
5. "Level" column indicating the levels of the respective categories of the game.
6. "Play History" column indicating the play histories of plays with other players.

The 5. "Level" column contains the following "Level" columns of the respective categories.

51. "Natural Science Category Level" column indicating the ability of the player for questions of the natural science category.
52. "Language/Literature Category Level" column indicating the ability of the player for questions of the language/literature categories.
53. "Social Science Category Level" column indicating the ability of the player for questions of the history/Geometry/Society categories.
54. "Entertainments Category Level" indicating the ability of the player for questions of the entertainments.
55. "Comics/Animations/Games Category Level" column indicating the ability of the player for questions of the entertainments.
56. "Sports Category Level" column indicating the ability of the player for questions of the sports category.
57. "Fashion/Gourmet Category Level" column indicating the ability of the player for questions of the fashion/Gourmet category.
58. "Hobbies/Miscellaneous knowledge Category Level" column indicating the ability of the player for questions of the hobbies/Miscellaneous knowledge category.

The 6. "Play History" column contains the "Play History" columns of n-players (Player 1 to Player n), although 8 players are contained in the Player data Table 110.

(Player Data Table of the Game Device)

The player data table stored in the game devices 12 of the game system according to the present embodiment will be explained with reference to FIG. 6.

The memory of each game device 12 stores a game player data table 130 of a player using the game device 12, and competitive player game data table 140 of a competitive player.

The player data table 130 of a player whose uses the game device 12 is illustrated in FIG. 6A. The player data table 130 is read from the server 30 in a competition to be stored in the memory of the gate device 12.

The competitive player data table 140 is illustrated in FIG. 6B. The competitive player data table 140 is read from the server 30 in a competition to be stored in the memory of the gate device 12.

The structure of the player data table 130 and the structure of the competitive player data table 140 as well contain "Rank" column and "Handicap" column in addition to the structure of the player data table of FIG. 5A registered in the memory of the server 30.

The "Rank" column indicates "a rank" decided by a competition score of competitions with a competitor. In the present embodiment, the ranks are 5 ranks, "Natural enemy", "Higher rank", "Even rank", "Lower rank" and "Easy mark".

The "Handicap" column indicates "a handicap" to be selected in a competition with a competitor. In the present embodiment, the handicaps are "No handicap", "Category handicap" and "Point handicap".

The "rank" and the "handicap" of the game system according to the present embodiment will be detailed later.

(Question Database)

The question database used in the game system according to the present embodiment will be explained with reference to FIG. 7.

The memory of the server 30 and the memory of each game device 12 store the question database 150 which is a collection of questions to be used in the game system.

The question database 150 is illustrated in FIG. 7. The question database 150 contains question classified based on the categories.

That is, the question database 150 contains questions of the quiz of the natural science category; questions of the quiz of the language/literature category; questions of the quiz of the history/geometry/society category; questions of the quiz of the entertainments category; questions of the quiz of the comics/animations/games categories; questions of the quiz of the sports category; questions of the quiz of the fashion/gourmet category; and questions of the quiz of the hobbies/miscellaneous knowledge category.

When a question of the quiz of the non-category is necessary, one of the questions a category selected at random is selected at random.

(Summary of Game Processing)

Figure 8:
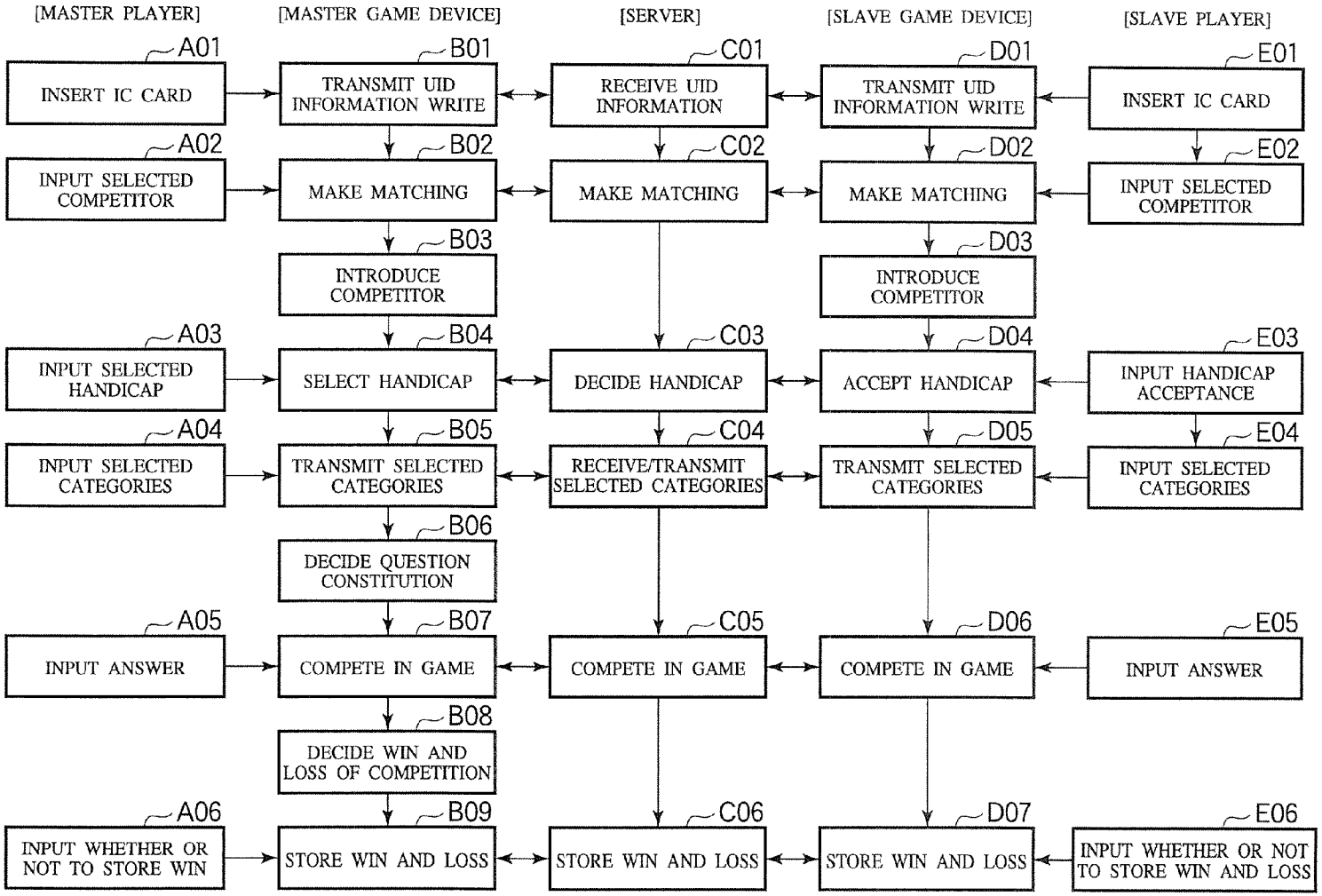
FIG. 8 is the flow chart of the competition game processing according to the embodiment of the present invention, which summarizes the competition game processing.

The game processing of the game system according to the present embodiment will be summarized with reference to the flow chart of FIG. 8.

The flow chart of FIG. 8 shows the operations of a master-side player, the processing of the master-side game device 12, the processing of the server 30, the operations of the slave-side player, and their inter-relationships.

The master-side game device 12 is a game device which leads and controls the game processing, and the slave-side game device 12 is a game device which controls the game processing under the lead of the master-side game device 12.

When 2 game devices 12 have been matched, either of the 2 game devices 12 is decided as the master-side game device 12 or the slave-side game device 12. However, for the convenience of the explanation, the master-side game device 12 and the slave-side game device 12 have been decided here in advance.

(Summary of Log-in Processing and Matching Processing)

First, the master-side player inserts the membership card 16 into the IC card I/F (interface) 18 of the master-side game device 12 (Step A01). The master-side game device 12 reads the identification information illustrated in FIG. 4 from the inserted membership card 16, and stores the identification information in its own player data table 130 (FIG. 6A) and also transmits the identification information to the server 30 (Step B01).

The server 30 receives the identification information of the membership card 16 of the master-side player from the mater-side game device 12 (Step C01) and stored the identification information in the player data table 110 (FIG. 5A) of the server 30.

The slave-side player inserts the membership card 16 into the I/C card I/F (interface) 18 of the slave-side game device 12 (Step E01). The slave-side game device 12 read the identification information of the membership card 16 illustrated in FIG. 4 from the inserted membership card 16, and stores the identification information in his own player data tale 130 (FIG. 6A) of his own slave-side game device 12 and also transmits the identification information to the server 30 (Step D01).

The server 30 receives the identification information of the slave-side player from the slave-side game device 12 (Step C01) and stores the identification information in the player data table 110 (FIG. 6A) of the server 30.

Then, the matching processing is made under the lead of the server 30 (Step C02). The matching processing is for selecting 2 competitive game devices 12 out of a number of game devices 12.

The menu of the game system according to the present embodiment contains the nationwide competition and the intra-store competition. The nationwide competition is the mode that players operating ones of the game devices 12 installed in amusement facilities 10 at nationwide locations compete. The intra-store competition is the mode that players operating the game devices 12 installed in the same amusement facility 10 compete.

When a player selects the nationwide competition or the intra-store competition, the game device 12 transmits a matching request to the server 30. The server 30 who has received the matching request from the game device 12 searches out of the other game devices 12 which have transmitted the matching requests, a game device which agrees with the conditions for the nationwide competition or the intra-store competition and selects the competitive game device 12 at random.

When none of the game devices 12 agree with the conditions, the server 30 adds and selects the CPU player to make the matching. The CPU player may be selected at random or in accordance with the level of the already matched player.

In the intra-store competition, in place of the server 30, the processing device 14 of the amusement facility 10 may make the matching processing.

In the matching processing of the present embodiment, a player can be selected by the master-side player making a competitor selection input (Step A02) the master-side game device 12 (Step B02).

In the same way, in the slave-side game device 12 as well, the matching processing in which a player can be selected by the slave-side player making a competitor selection input (Step E02) is made (Step D02).

When the matching of 2 game devices 12 is decided, the server 30 transmits to the master-side game device 12 the received identification information of the master-side player.

The master-side game device 12 receives the identification information of the slave-side player transmitted from the server 30 and stores the identification information in the player data table 140 (FIG. 6B) of the competitor of the master-side game device 12, and displays an image which introduces the competitor (Step B03).

In the same way, the slave-side game device 12 receives the identification information of the master-side player transmitted from the server 30 and stores the identification information in the player data table 140 (FIG. 6B) of the competitor of the slave-side game device 12, and displays an image introducing the competitor (Step D03).

In the matching processing described above, competitors are matched unconditionally at random with all players who are logging in, but players having competition scores recorded may be preferentially matched in consideration of the handicapped competition of the present embodiment.

When a player is matched, it is first detected whether players having the scores of the competitions with the player recorded are logging in (8 players at maximum in the present embodiment), and a competitor is selected preferentially out of the logging-in players having the competition scores recorded, and the player is matched.

(Summary of Handicap Deciding Processing)

When the matching processing by 2 competitive players has been completed, the handicap deciding processing for deciding a handicap to be imposed in the competitive game is made.

The handicap deciding processing is for deciding, by a choice of the players, a handicap for the competitive game, based on competition scores of the 2 competitive players.

The server 30 decides a handicap for the competitive game by deciding ranks (natural enemy, higher rank, same rank, lower rank, easy mark, etc.) of the 2 competitive players game, based on the competition scores of the 2 competitive players, and by the lower-rank player selecting a handicap and the higher-rank player accepting the handicap (Step C0).

The higher-rank player can be said to be a player whose competition score is high and who is relatively strong (the strong-side player). The lower-rank player can be said to be a player whose competition score is low and who is a relatively weak player (the weak-side player).

When the player of the master-side game device 12 is ranked lower, the master-side player makes a handicap selection input (Step A03) and selects a handicap (no handicap, category handicap, point handicap, etc.) to be proposed to the higher-rank player (Step B04).

As for the handicap proposed by the master-side player, the slave-side player, who is ranked higher, makes a handicap acceptance input (Step E03) to accept the proposed handicap (Step D04).

(Relationship Between Matching Processing and Handicap Deciding Processing)

In the present embodiment, in the handicap determining processing, the lower-rank player selects a handicap and proposes the handicap to the high-rank player, and the higher-rank player can select whether or not to accept the proposed handicap. A handicap gives a disadvantage to a player in the game competition, and even a higher-rank player always rejects a handicap if he sticks to win and loss.

Accordingly, the handicap deciding processing of the present embodiment is unacceptable to competition games in which wins and losses are very important, such as nationwide competitions in which prizes are to be given. The handicap deciding processing of the present embodiment is suitable to intra-store competition games in which competitors are acquainted friends, etc., and enjoy the games themselves rather than the win and loss.

In the matching processing of the present embodiment, as described above, in the matching a player can reject a competitor, whereby it is possible to select a competitor as a partner. The handicap deciding processing of the present embodiment is suitable to such matching processing.

(Summary of Question Deciding Processing)

When the handicap deciding processing by the 2 competitive players is completed, the question deciding processing of deciding a constitution of quiz questions in the competition game is made.

The question deciding processing is for deciding a question constitution for the competition game in accordance with a category selection of the 2 competitive players.

The master-side player makes a category selection input (Step A04), and the master-side game device 12 transmits the selected category to the server 30 (Step B05). In the same way, the slave-side player makes a category selection input (Step B-4), and the slave-side game device 12 transmits the selected category to the server 30 (Step D05).

The server 30 receives the selected category transmitted from the master-side game device 12 and transmits the selected category to the slave-side game device 12, and receives the selected category transmitted form the slave-said game device 12 and transmits the selected category to the master-side game device 12 (Step C04).

The master-side game device 12 decides a question constitution for the competition game in accordance with the category selections of the 2 competitive players (Step B06).

When a handicap is the category handicap, the category selection of the higher-rank player is prohibited, and the question constitution is decided by the category input alone of the lower-rank player. For example, the question constitution contains questions of the category selected by the lower-rank player and non-category questions.

(Summary of Game Competition Processing)

When the question deciding processing of the competition game has been completed, the game competition processing is made by the 2 players.

Based on an answer input of the master-side player (Step A05) and an answer input of the slave-side player (Step B05), the game competition processing is made under the lead of the master-side game device 112 in cooperation with the server 30 and the slave-side game device 12 (Step B07, Step C05, Step D06).

As a result of the game competition, the master-side game device 12 decides the win and loss of the game competition (Step B08).

(Summary of Win and Loss Storing Processing)

When the game competition processing has been completed by the 2 players, the win and loss storing processing for storing a result of the competition game is made.

In accordance with a win and loss storage input by the master-side player as to whether or not to store the win and loss (Step A06), the master-side game device 12 records a result of the competition game by the 2 game players in the player data table 130 (Step D07).

In accordance with a win and loss storage input by the slave-side player as to whether or not to store the win and loss (Step B06), the slave-side game device 12 records a result of the competition game by the 2 game players in the player data table 130 (Step D07).

In the same way, the server 30 also records a result of the competition game by the two in the player data table 110 of the server 30.

(Details of Game Processing)

Each processing of the game processing of the game system according to the present embodiment, i.e., the matching processing, the handicap deciding processing, the point handicapped competition processing, category handicapped competition, the game competition processing, the rank shift effect processing, the win and loss storage processing will be detailed with reference to the flow charts, game images, etc.

(Details of the Matching Processing)

Figure 9:
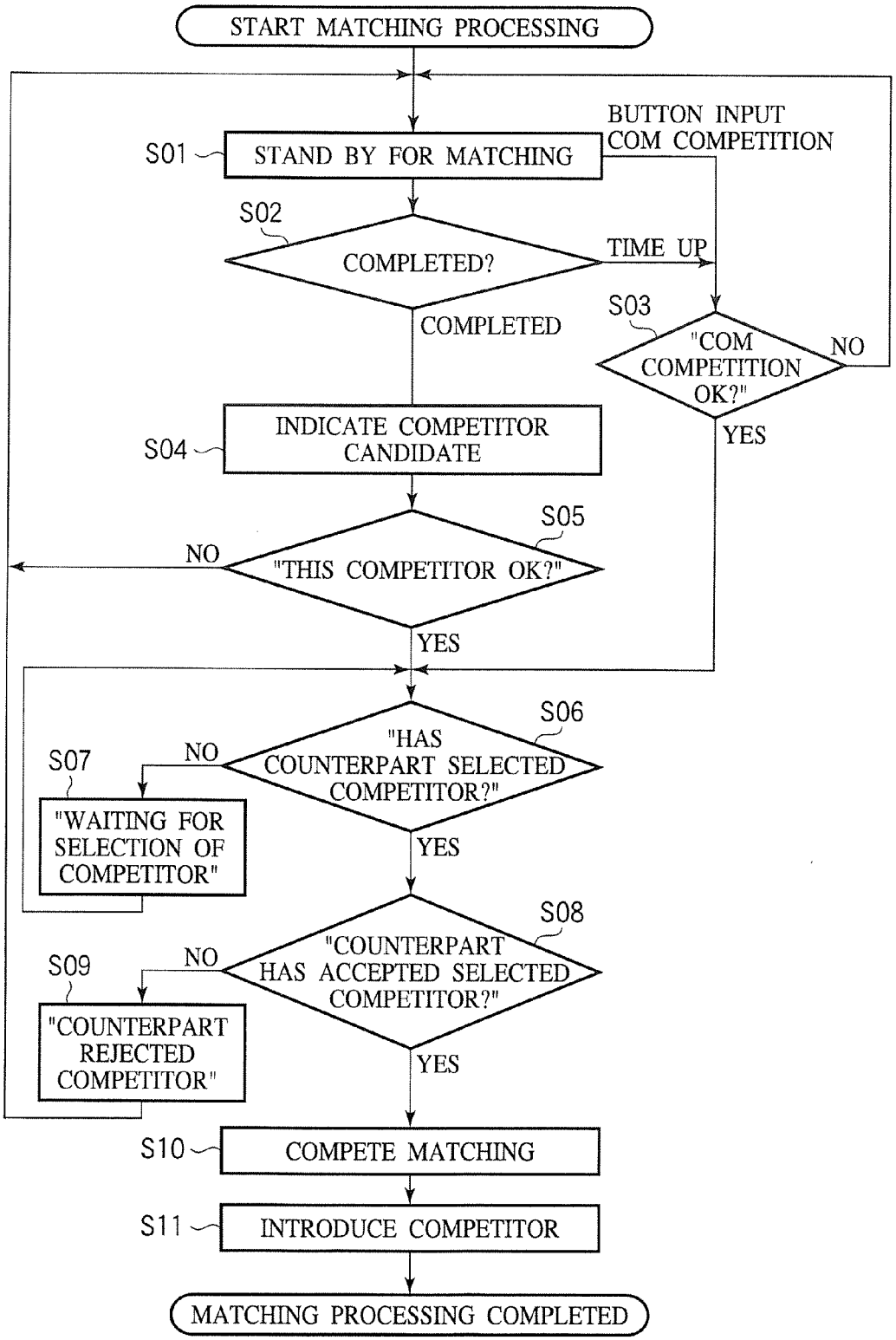
FIG. 9 is the flow chart of the matching processing of the embodiment of the present invention.

The matching processing of the game system according to the present embodiment will be detailed with reference to FIGS. 9 to 13. FIG. 9 is the flow chart of the matching processing. FIG. 10 is views of game images in the matching processing. FIG. 11 is views of a list of the categories and a list of match tiles in the matching processing. FIG. is views of game images of the introduction of competitors.

The matching processing in the master-side game device 12 and the matching processing in the slave-side game device 12 are the same, and the explanation is indiscriminately for both.

When a player inserts the membership card 16 into a game device 12 and logs in, the server 30 starts the matching, and the game device 12 is standing by for the matching (Step S01).

Figure 10A:
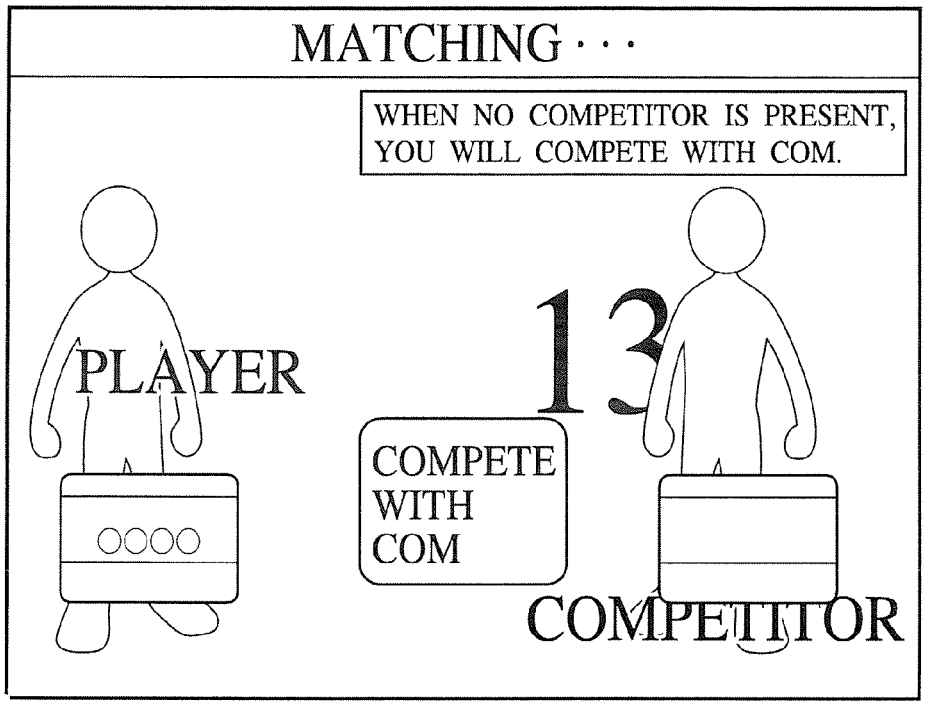
FIG. 10 is views illustrating game images of the matching processing of the embodiment of the present invention.

On the stand-by for the matching, the image of FIG. 10A is displayed on the display monitor 34 of the game device 12. At an upper part of the game image, "Matching . . . " is indicated, on the left side, the information of the logging-in player (OOOO) is indicated, on the right side, the information of a player to be matched and a remaining time of the matching processing ("13" seconds in FIG. 10A) are indicated. At the center of the game image, a "Compete with COM" button for selecting the competition with a COM player is indicated.

Figure 10B:
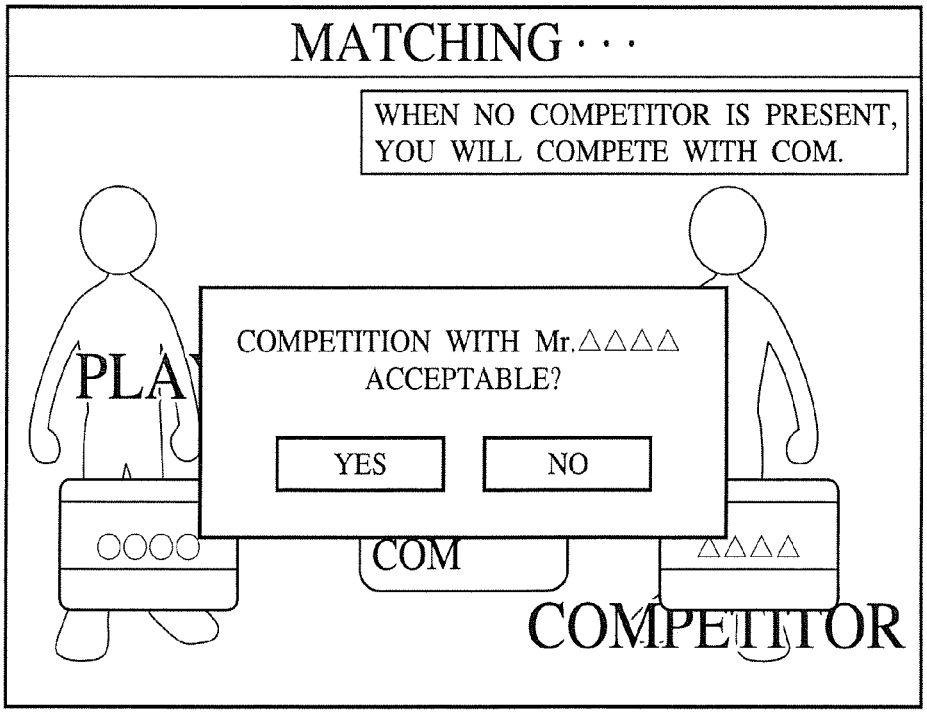

Next, the server 30 judges whether or not the matching has completed (Step S02). When the matching is completed, on the display monitor 34 of the game device 12, as illustrated in FIG. 10B, the player name (Δ Δ Δ Δ) of a candidate competitor is indicated on the left of the game image, and at the center of the game image, the letters "Competition with Mr. Δ Δ Δ Δ all right?" and a selection buttons "Yes" and "No" for accepting the matching are indicated (Step S05)

Unless the player accepts the matching, the processing returns to Step S01, and the game device 12 is on stand-by for the matching.

When the player accepts the matching, it is judged whether or not the counterpart has decided to accept the matching (Step S06), and when the counterpart has not decided to accept the matching, "Waiting for the selection of the competitor" is indicated on the game image (Step S07), and the processing returns to Step S06.

When the competitor selection of the counterpart is "Yes" (Step S08), the matching is completed (Step S10), and the game device 2 displays the game image introducing the competitor (Step S11).

When the competitor selection of the counterpart is "No" (Step S08), "Rejected by the competitor" is indicated on the game image (Step S09), and the processing returns to Step S01. The game device 2 is on stand-by for the matching.

The competition with the COM player is made when the player operates the button "Compete with COM" on the stand-by for the matching in Step S01 or when a matching processing period of time is completed in matching completion judgment in Step S02, the competition with the COM player is made.

Even in the competition with a COM player, whether or not a matching is accepted can be selected. For example, as in the game image of FIG. 10B, on the left of the game image, the name (COM) of a candidate competitor is indicated, at the center of the game image, the letters "Competition with COM player is all right?" and the selection buttons ("Yes" and "No") for selecting whether or not to accept the matching are indicated (Step S05).

Unless the player accepts the matching, the processing returns to Step S01, and the game device is on stand-by for the matching. When the player accepts the matching, the processing proceed to Step S06, and the following processing described above is continued.

Next, the game image introducing the competitor in Step S11 will be detailed.

In the game system according to the present embodiment, ranks of both players are decided, based on competition scores of the competitions with the counterpart player, and a match title of the competition is decided.

The decided ranks are stored in the ranks of the player data table 130 and the ranks of the competitive player data table 140 in FIG. 6A.

A list of ranks is illustrated in FIG. 11A. The ranks illustrated in FIG. 11A are one example, and the ranks are not limited to them.

The ranks are roughly classified in "Higher rank", "Same rank" and "Lower rank", depending on competition scores with a competitor.

A competitor the competition score of competitions with whom has more losses than wins is "Higher rank (Rank No. 2" in principle. A competitor 5 or more of 10 competitions with whom are lost is "Natural enemy (Rank No. 0" which is an especially higher rank.

A competitor the competition score of competitions with whom has equal wins and equal losses is "Same rank (Rank No. 3)". A competitor wins and losses of totally 5 or more competitions with whom are equal is "Rival (Rank No. 5)" which is a special same rank. A competitor wins and losses of totally 20 or more competitions with whom is "Destined rival (Rank No. 5)" which is a further special same rank.

A competitor a competition score of competitions with whom has more wins than losses is "Lower rank (Rank No. 3)" in principle. A competitor 5 or more of totally 10 or more competitions with whom are wins is "Easy mark (Rank No. 4)" which is a special lower rank.

The rank is "Higher rank" or "Lower rank", the rank (Natural enemy or Higher rank, or Lower rank or easy mark) is indicated on the game image of the competitor. When the rank is "Same rank", a rank "Same rank, Rival or Destine rival" is indicated at the center of the game image.

A list of match titles of the competitions is illustrated in FIG. 11B. The list of the match titles illustrated in FIG. 11B is one example and is not essential.

When a competition with competitors is the first time, "First competition (Title No. 0)" is indicated. When the previous competition with a competitor was lost, "Revenge match (Title No. 1)" is indicated. When the previous competition with a competitor was won, "Return match (Title No. 2)" is indicated. When the previous competition with a competitor was drawn, "Destined competition (Title No. 3)" is indicated. When the ranks of competitors are "Rival (Rank NO. 5) or "Destined rival (Rank No. 5), "Two great competitors battle (Title No. 4)" is indicated irrespective of a win and loss of the previous competition. The match title is displayed at the center of the game image.

Figure 12A:
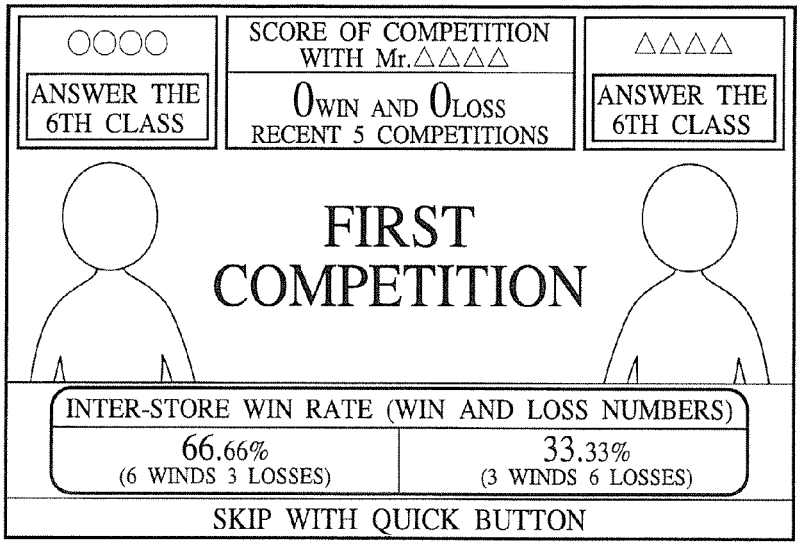
FIG. 12 is views illustrating the game images for introducing competitors in the matching processing of the embodiment of the present invention (Part 1).
Figure 12B:
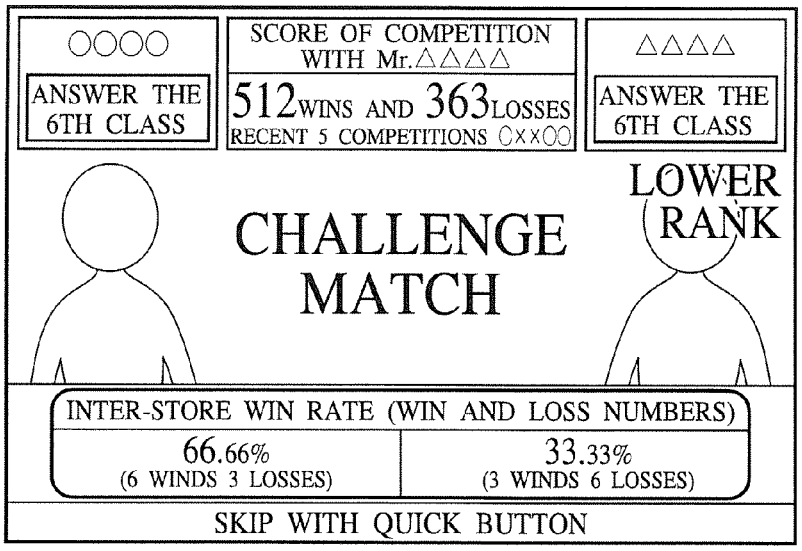
Figure 12C:
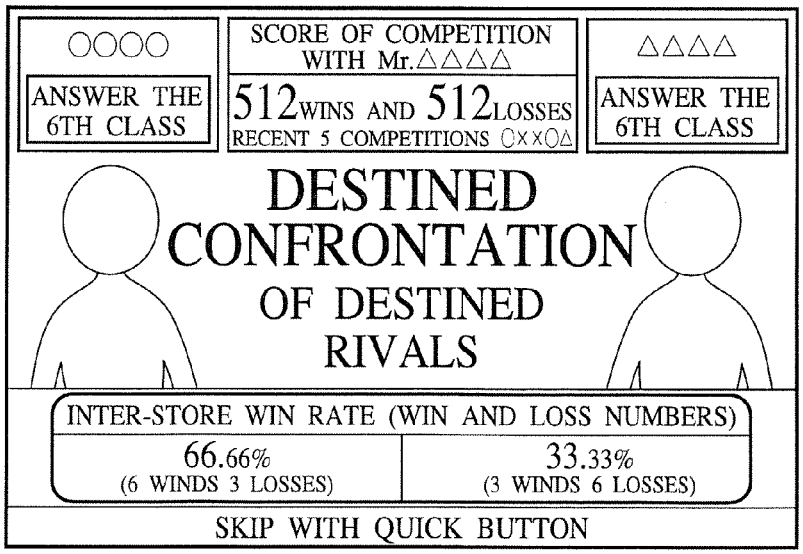
Figure 13:
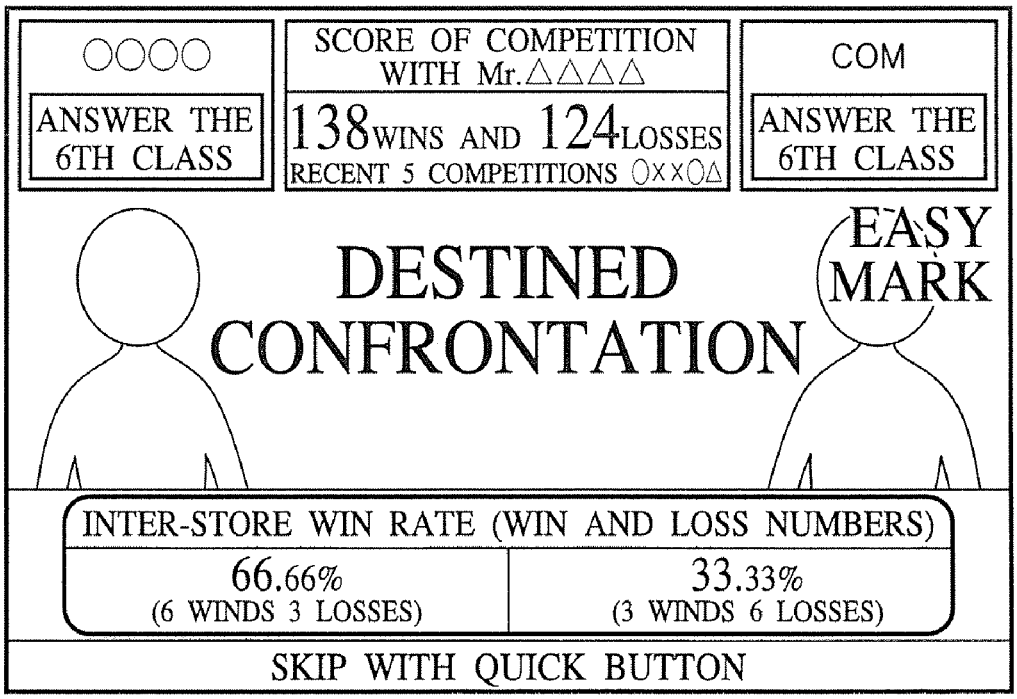
FIG. 13 is a view illustrating a game image for introducing competitors in the matching processing of the embodiment of the present invention (Part 2).

FIGS. 12 and 13 illustrate examples of the game images introducing competitors.

FIG. 12A is the game image for the first competition of competitors. "First competition" is indicated at the center of the game image.

FIG. 12B is the game image for the case that a competitor is "Lower rank", and the previous competition with the competitor was won. "Lower rank" is indicated on the right of the game image, and at the center of the game image, "Return match" is indicated.

FIG. 12C is the game image for the case that competitors are "Same rank", and the previous competition was drawn, "Destined rival" is indicated at the upper central part of the game image, and "Destined battle" is indicated below.

FIG. 13 is the game image for the case that a competitor is a COM player: for the case that the competitor, the COM player is "Lower rank (Easy mark), and the previous competition with the COM player was drawn. "COM" is indicated as the competitor on the right of the game image, "Easy mark" is indicated as the rank, and at the center of the game image, "Destined battle" is indicated.

In the present embodiment described above, after the matching has been completed, and competitors have been decided, the game image introducing the competitors is indicated. However, detailed information, such as ranks, match titles, etc. may be displayed for candidate competitors before matched, which allows players to judge whether or not to accept the matching after the detailed information of the competitors.

(Details of the Handicap Deciding Processing)

The handicap deciding processing of the game system according to the present embodiment will be detailed with reference to FIGS. 14 to 18. FIG. 14 is the flow chart of the handicap deciding processing. FIG. 15 is a list of handicaps of the handicap deciding processing, and FIGS. 16 to 18 are views of the game images of the handicap deciding processing.

When the server 30 has completed the matching processing, the server 30 starts the handicap deciding processing. The handicap deciding processing is for deciding a handicap for a competition by a selection of 2 competitive players, based on a competition score of the 2 competitive players. The server 30 decides ranks (Natural enemy, Higher rank, Same rank, Lower rank, Easy mark, etc.), based on competition scores of the 2 players and decides a handicap for the competition game, based on a handicap selection by the lower-rank player and the acceptance of the handicap by the higher-rank players. When the decided ranks are equal, the handicap deciding processing is not made.

In the handicap deciding processing, the operation is different between the lower-rank game device 12 and the higher-rank game device 12. The lower-rank game device 12 and the higher-rank game device 12 will be separately explained. FIG. 14A illustrates the processing of the lower-rank game device 12, and FIG. 14B illustrates the processing of the higher-rank game device 12.

A list of the handicaps to be selected is illustrated in FIG. 14. The handicaps illustrated in FIG. 14 are one example, and the handicaps are not limited to them.

The handicaps are roughly classified in "Without handicap" in which no handicaps are given, "Category handicap" in which the higher-rank player is prohibited from selecting a category and "Point handicap" in which points are given to the lower-rank player at the start of the game. The weight of a handicap to be selected is restricted based on a decided rank.

In the quiz game of the present embodiment, the question constitution is decided by the categories selected by both players. Accordingly, when the category selection is prohibited by "Category selection", questions of a favorable category are disadvantageously few, which is the handicap.

The quiz game of the present embodiment is based on the first point win system wherein-a competitor who has obtained prescribed points (e.g., 30 points) in advance wins. Accordingly, when "Point handicap" points (e.g., 10 points) are given in advance, it is advantageous, which gives a handicap to the competing player.

"Handicap No. 0" is the case that no handicap is given. "Handicap No. 0" is indicated as one choice in all the cases.

"Handicap No. 1" is a handicap that a higher-rank competitor is prohibited from selecting a category only in Round 1 of a plurality of rounds of a game, "Handicap No. 1" is indicated as a choice when the rank is "Natural Enemy". The weight of the handicap is "Light".

"Handicap No. 2" is a handicap that a higher-rank player is prohibited from selecting a category in all of a plurality of rounds of a game. The weight of the handicap is "Light".

"Handicap No. 3" is a handicap that +10 points are given to a lower-rank player at the start of a game in Round 1 of a plurality of rounds of the game. "Handicap No. 3" is indicated as a choice when the rank is "Higher rank". The weight of the handicap is "Medium".

Handicap No. 4" is a handicap that +points are given to a lower-rank player at the start of a game in all of a plurality of rounds of the game. "Handicap No. 4" is indicated as a choice when the rank is "higher rank". The weight of the handicap is "Medium".

"Handicap No. 5" is a handicap that +20 points are given to a lower-rank player at the start of a game only in Round 1 of a plurality of rounds of the game. "Handicap No. 5" is indicated as a choice when the rank is "Natural enemy". The weight of the handicap is "Medium".

"Handicap No. 6" is a handicap that +20 points are given to a lower-rank player at the start of a game in all of a plurality of rounds of the game. "Handicap No. 6" is indicated as a choice when the rank is "Natural enemy". The weight of the handicap is "Heavy".

First, on the display monitor 34 of the higher-rank game device 12, the game image indicating the handicap choices as illustrated in FIG. 16A is displayed (Step S21). At the center of the game image, the letters "Mr. Δ Δ Δ Δ is ranked higher. Do you ask for a handicap?" and the 4 handicap choices, i.e., "Don't ask for.", "Ask not to select categories only in ROUND 1.", "Ask for +10 pt start only in ROUND 1." "Ask for +10 pt start in all ROUNDS." are indicated.

At this time, on the display monitor 34 of the higher-rank game device 12, the game image indicating a handicap being selected as illustrated in FIG. 16A2 is displayed (Step S31). At the center of the game image, the letters "Mr. OOOO, lower-rank player is selecting a choice." is indicated.

Next, the lower-rank game device 12 judges whether or not the lower-rank player has selected a choice of asking for a handicap out of the 4 handicap choices (Step S22). Simultaneously, the higher-rank game device 12 also judges whether or not the lower-rank player has selected a choice of asking for a handicap out of the 4 handicap choices (Step S32).

When the lower-rank player selects a choice of asking for a handicap, the game image indicating being asking for a handicap as illustrated in FIG. 16B1 is displayed on the display monitor 34 of the lower-rank game device 12 (Step S23). The letters "Asking for Mr. Δ Δ Δ Δ, higher-rank player." is indicated at the center of the game image.

At this time, the game image asking for a handicap as illustrated in FIG. 16B2 is displayed on the display monitor 34 of the higher-rank game device 12 (Step 33). The letters "Mr. OOOO, lower-rank player has asked 'to start with +10 pts in all the ROUNDs'." and 2 choices, "Accept" and "Reject" are displayed at the center of the game image.

Then, the higher-rank game device 12 judges whether or not the higher-rank player has accepted the handicap (Step S34). Simultaneously, the lower-rank game device 122 also judges whether or not the higher-rank player has accepted the handicap (Step S24).

When the higher-rank player has selected the choice of accepting the handicap, the game image indicating that the handicap will be used as illustrated i FIG. 17A2 is displayed on the display monitor 34 of the higher-rank game device 12 (Step S35). The letters "Accepted 'Start with +10 pts in all the ROUNDS'." are indicated at the center of the game image.

At this time, the game image indicating that the handicap will be used as illustrated in FIG. 17A1 is displayed on the display monitor 34 of the lower-rank game device 12 (Step S25). The letters "Mr. Δ Δ Δ Δ, higher-rank player has accepted" are indicated at the center of the game image.

On the other hand, when the higher-rank player has selected a choice of rejecting the handicap, the game image indicating rejecting the handicap as illustrated in FIG. 17B2 is displayed on the display monitor 34 of the higher-rank game device 12 (Step S36). The letters "Rejected 'Ask for starts with +10 pts in all the ROUNDS!' He will think over again." are indicated at the center of the game display.

At this time, the game image indicating the handicap has been rejected as illustrated in FIG. 17A2 is displayed on the display monitor 34 of the lower-rank game device 12 (Step S26). The letters "Mr. Δ Δ Δ Δ, higher-rank player has rejected. Ask once more." is displayed at the center of the game image. Then, the processing returns to Step S21.

In Step S22, when it is judged that the lower-rank player has selected "Ask for no handicap", the game image indicating no handicap will be used as illustrated in FIG. 18A is displayed on the display monitor 34 of the lower-rank game device 12 (Step S27). The letters "Ask for no handicap." are indicated at the center of the game image.

At this time, on the display monitor of the higher-rank game device 12 as well, the game image indicating no handicap will be used as illustrated in FIG. 18A2 is displayed (Step S37). The letters "He needs no handicap." are indicated at the center of the game image.

A decided handicap is stored in the player data table 130 of FIG. 6A and in "Handicaps" column of the competitor data table 140.

(Details of the Point Handicapped Competition Processing)

Figure 32:
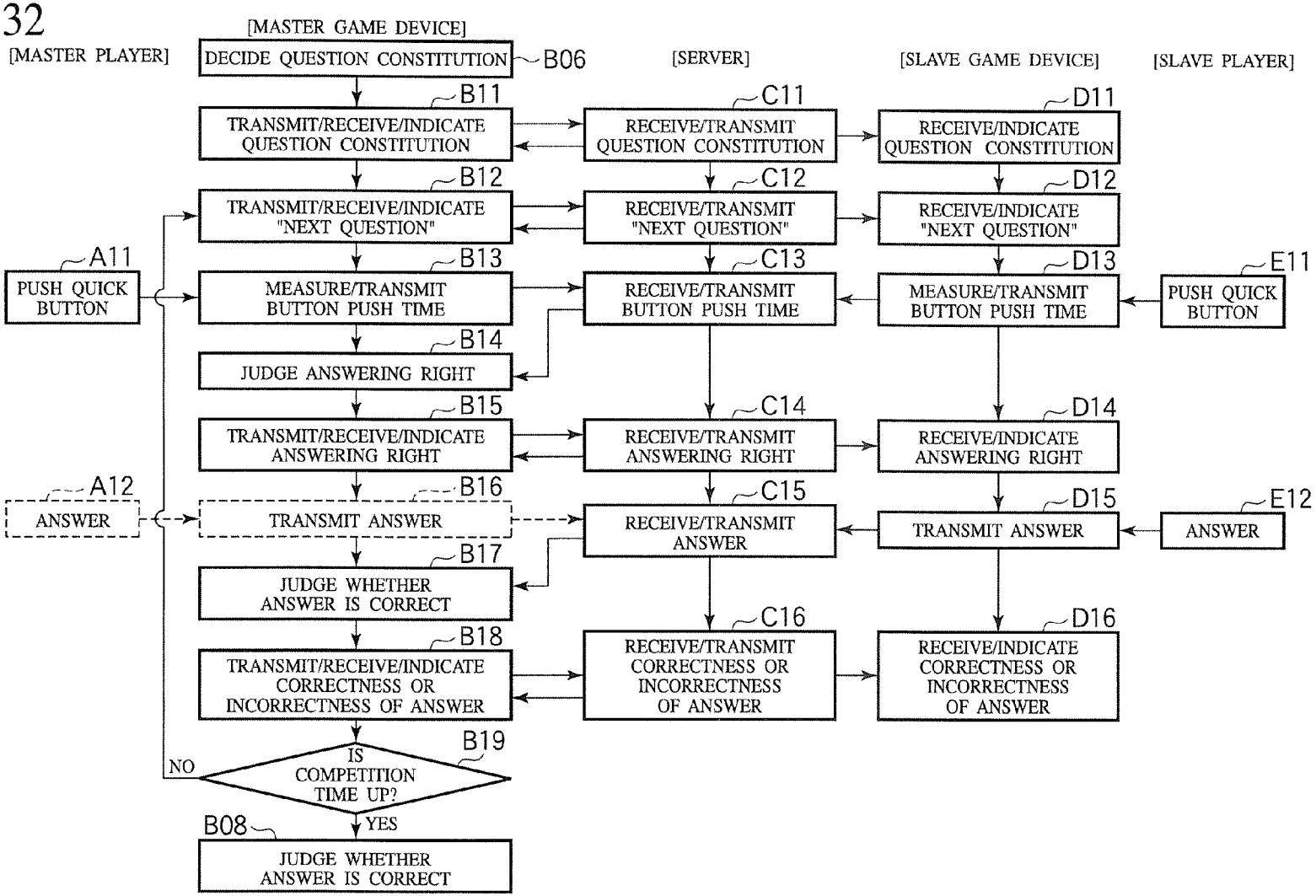
FIG. 32 is the flow chart of the competition game processing of the embodiment of the present invention, which details the competition game processing.

The point handicapped competition processing of the game system according to the present embodiment will be detailed with reference to FIGS. 19 to 32. FIGS. 19 to 29 are views illustrating the game images of the point handicapped competition processing. FIG. 30 is views of question balls of the competition game processing. FIG. 31 is views illustrating question constitution tables of the competition game processing. FIG. 32 is the flow chart detailing the competition game processing.

The point handicapped competition is a handicapped competition in which points are given to a lower-rank player at the start of the game. The category selection of a higher-rank player is not prohibited.

Figure 19A:
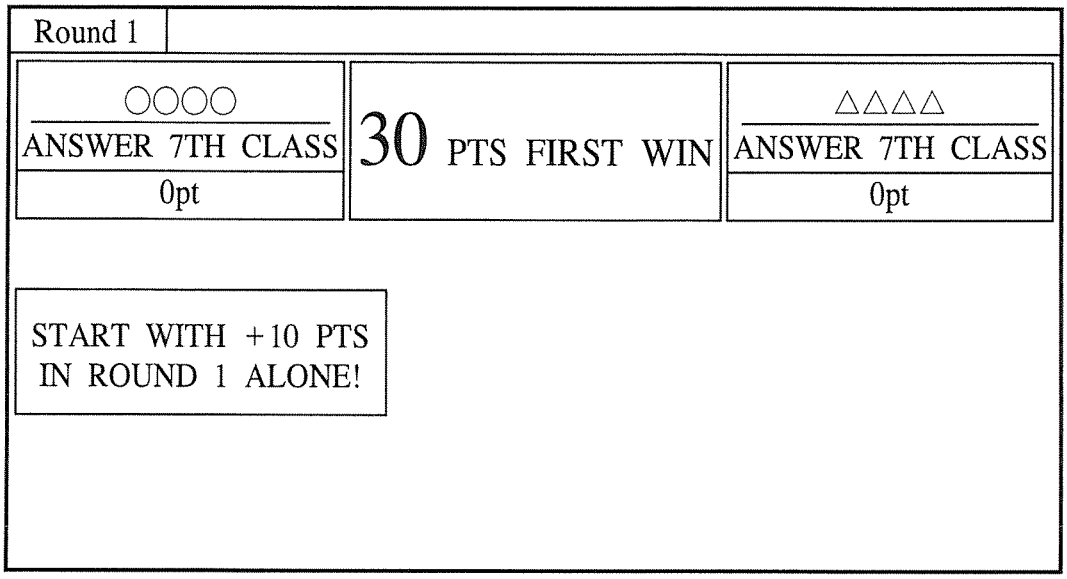
FIG. 19 is views illustrating the game images of the point handicapped competition processing of the embodiment of the present invention (Part 1).
Figure 19B:
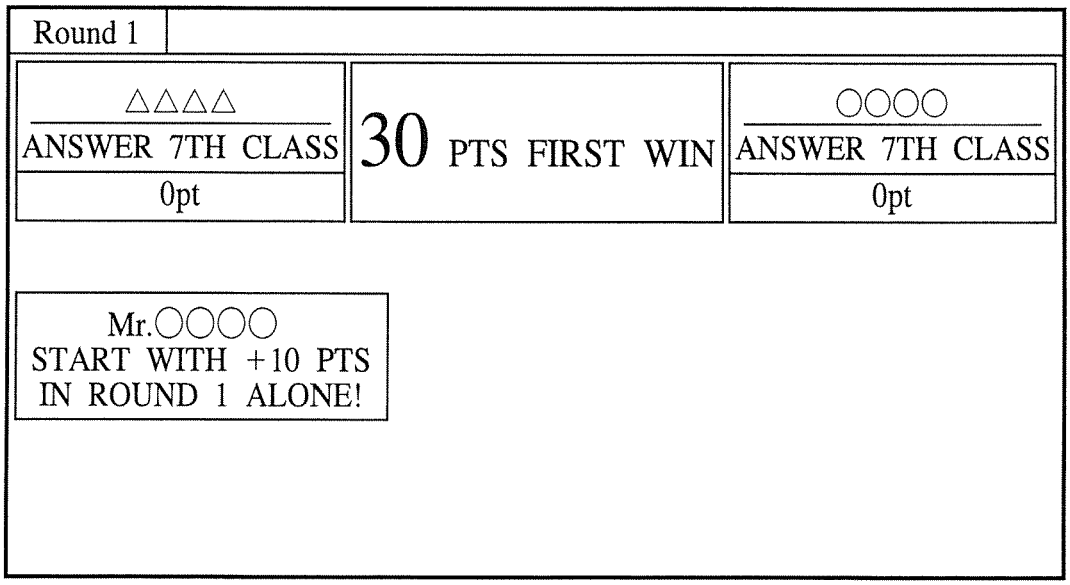

Before the game competition is started, first the game image indicating the competition is pint-handicapped as illustrated in FIG. 19A is displayed on the display monitor 34 of the lower-rank game device 12. At an upper central part of the game image, it is indicated that the game is played with 30 points given in advance, and on the left of the game image, the letters "Only 1 ROUND starts with +10 points." are indicated.

On the display monitor 34 of the higher-rank game device 12 as well, the game image indicating a point-handicapped competition is made as illustrated in FIG. 19A is displayed. At an upper central part of the game image, it is indicated that the game is played with 30 points given in advance, and on the left for the game image, the letters "Mr. OOO starts ROUND 1 alone with +10-points" are indicated.

(Category Selection Processing)

Next, the category selection is made.

Figure 20:
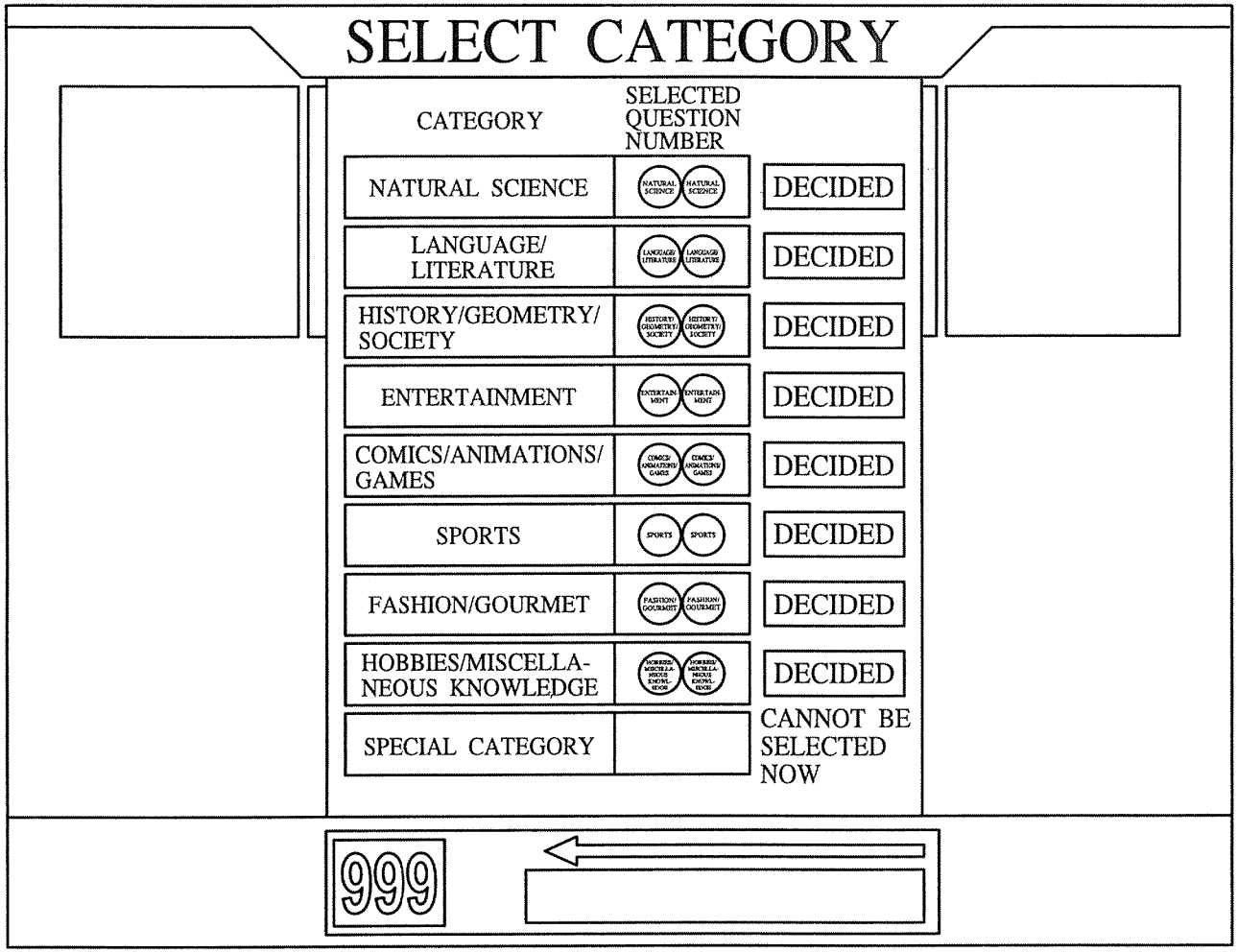
FIG. 20 is a view illustrating the game image of the point handicapped competition processing of the embodiment of the present invention (Part 2).
Figure 21:
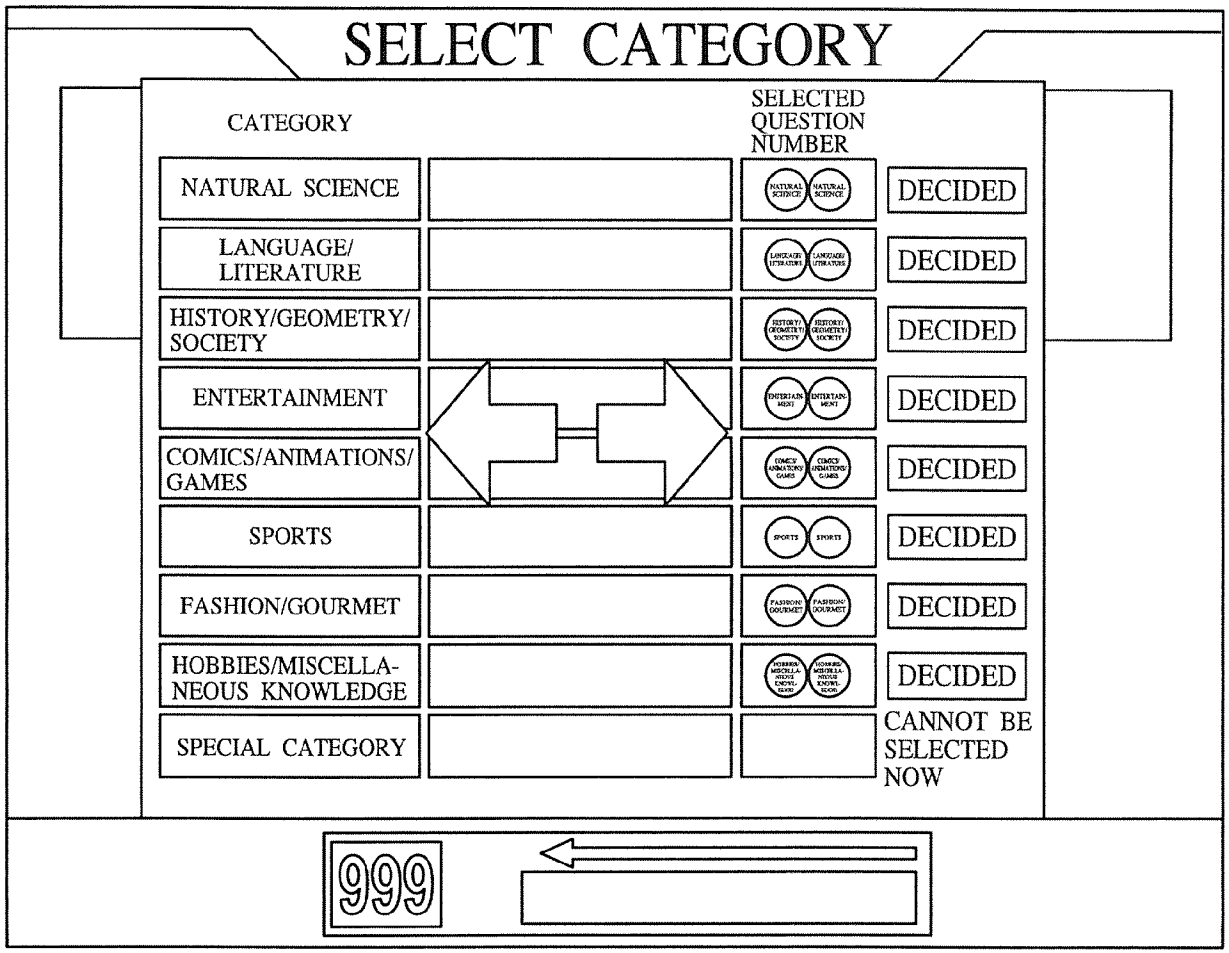
FIG. 21 is a view illustrating the game image of the point handicapped competition processing of the embodiment of the present invention (Part 3).
Figure 22:
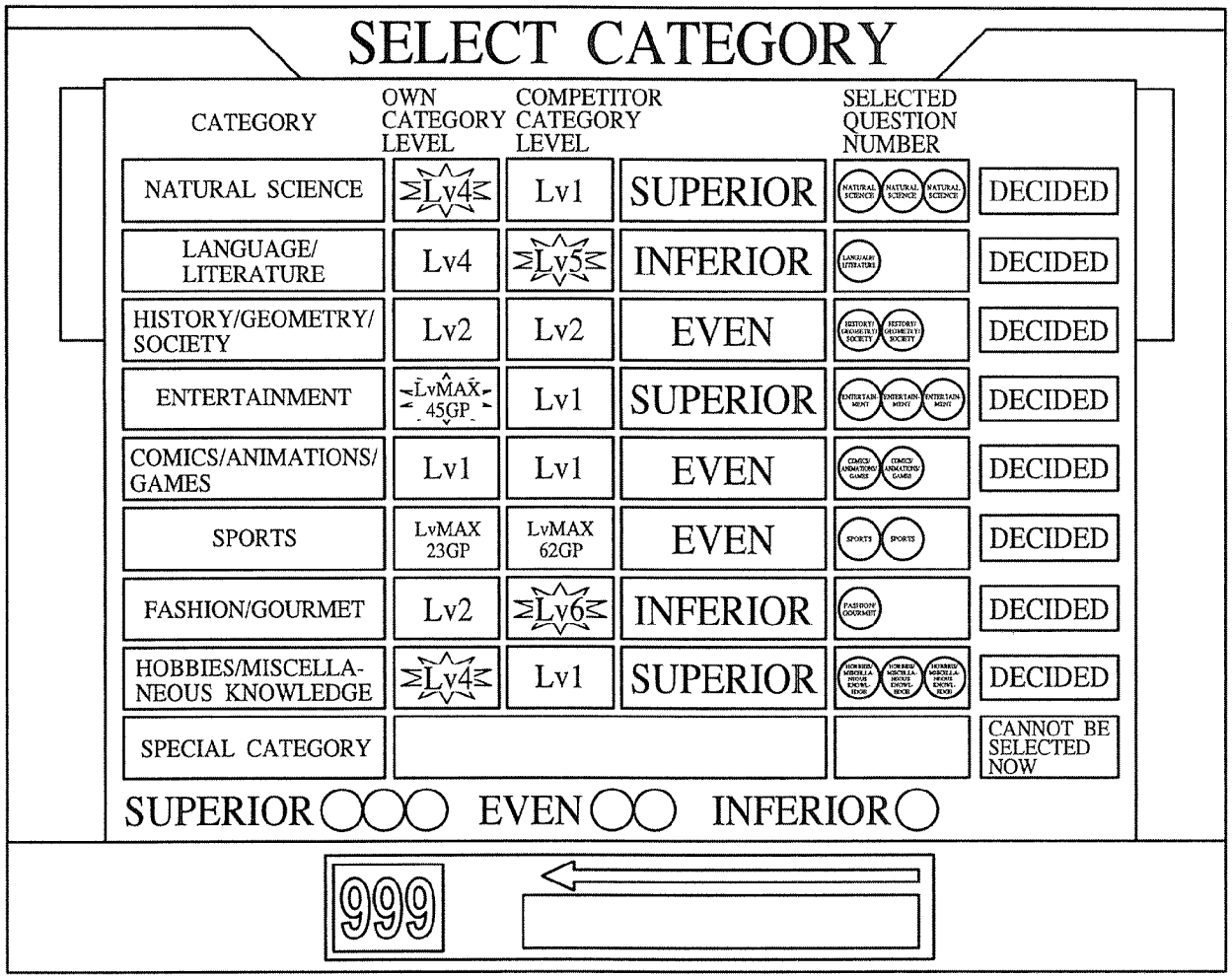
FIG. 22 is a view illustrating the game image of the point handicapped competition processing of the embodiment of the present invention (Part 4).

On the display monitor of the master-game device 12, the category selection images as illustrated in FIGS. 20 to 22 are displayed.

On the category selection image, first, as illustrated in FIG. 20, at the center of the image, the categories of the quiz (Natural science category, Language/Literature category, History/Geometry/Society category, Entertainments category, Comics/Animations/Games category/Sports category/Fashion/Gourmet category, Hobbies/Miscellaneous knowledge category), numbers of questions-to-be-selected and decision buttons are indicated. The numbers of questions-to-be-selected are indicated by numbers of balls. In FIG. 20, 2 balls are indicated as the normal question number. The category names are indicated on the balls.

Then, for the comparison with the competitor in the levels of the respective categories, the animation image in which the quiz category column and the question-to-be-selected number column are spaced from each other as illustrated in FIG. 21 is displayed, and then the category selection image as illustrated in FIG. 22 is displayed.

On the category selection image, as illustrated in FIG. 22, the categories of the quiz (Natural science category, Language/Literature category, History/Geometry/Society category, Entertainments category, Comics/Animations/Games category, Sports category, Fashion/Gourmet category, Hobbies/Miscellaneous knowledge category), own levels of the respective categories, levels of the competitor, level comparison results, numbers of questions-to-be-selected are indicated.

The comparison results are indicated by 3 levels of "Superior", "Even" and "Inferior". The numbers of questions-to-be-selected are normally 2 for "Even"; for "Superior", 1 question is added to 2 questions, for "Even", i.e., 3 questions; and for "Inferior", 1 question is subtracted from the normal 2 questions, i.e., 1 question. The numbers of questions-to-be-selected are indicated by numbers of balls with the categories indicated.

In Natural science category, the competitor is "Level 1" vs. the own "Level 4". The comparison result is "Superior", and the questions-to-be-selected number is "1 question".

In Language/literature category, the competitor is "Level 5" vs. the one "Level 4". The comparison result is "Inferior", and the question-to-be-selected number is "2 questions".

In History/geometry/society category, the competitor is "Level 2" vs the own "Level 2". The comparison result is "Even", and the question-to-be-selected number is "2 questions".

In Entertainments category, the competition is "Level 1" vs. the own "Level MAX (45 GP)". The comparison result is "Superior", and the question-to-be-selected number is "3 questions".

"GP" is a kind of experimental values called category point. For a player of Level MAX, when the counterpart is also Level MAX, the superiority and inferiority of the player cannot be judged, and the category point is additional indicated to the level indication. The category level may be additionally indicated for the levels below Level MAX.

In Comics/animations/games category, the competitor is "Level 1" vs. the own "Level 1". The comparison result is "Even", and the question-to-be-selected number is "2 questions".

In Sports category, the competitor is "Level MAX (62 GP)" vs. the own "Level 1". The comparison result is "Even", and question-to-b-selected number is "2 questions".

In Fashion/Gourmet category, the competitor is "Level 6" vs. the own "Level 2". The comparison result is "Inferior", and the question-to-be-selected number is "1 question".

In Hobbies/Miscellaneous knowledge category, the competitor is "Level 1" vs. the own "Level 4". The comparison result is "Inferior", and the question-to-be-selected number is "3 questions".

Based on the comparison results, noticeable marks are given to the superior level columns. As illustrated in FIG. 22, in the own level column, the marks are given to Natural science category, Entertainments category, Hobbies/Miscellaneous knowledge category, and in the competitor level column, the marks are given to Language/literature category and Fashion/Gourmet category. These marks are guides in selecting categories.

As described above, "Superior", "Even" and "Inferior" are judged based on only comparison results of the comparison between the competitor levels and the own levels irrespective of the absolute values of the levels, and based on the judgments, the question-to-be-selected numbers are decided.

On the other hand, on the display monitor 34 of the same game device 12, the same category selection image illustrated in FIG. 21 is displayed.

As the category selection image, first, the same image as in FIG. 20 is displayed, then the same image as in FIG. 21 is displayed, and the category selection image as in FIG. 22 is displayed. However, the own category level and the competitor level illustrated in FIGS. 20, 21, 22 are replaced by each other.

Figure 23:
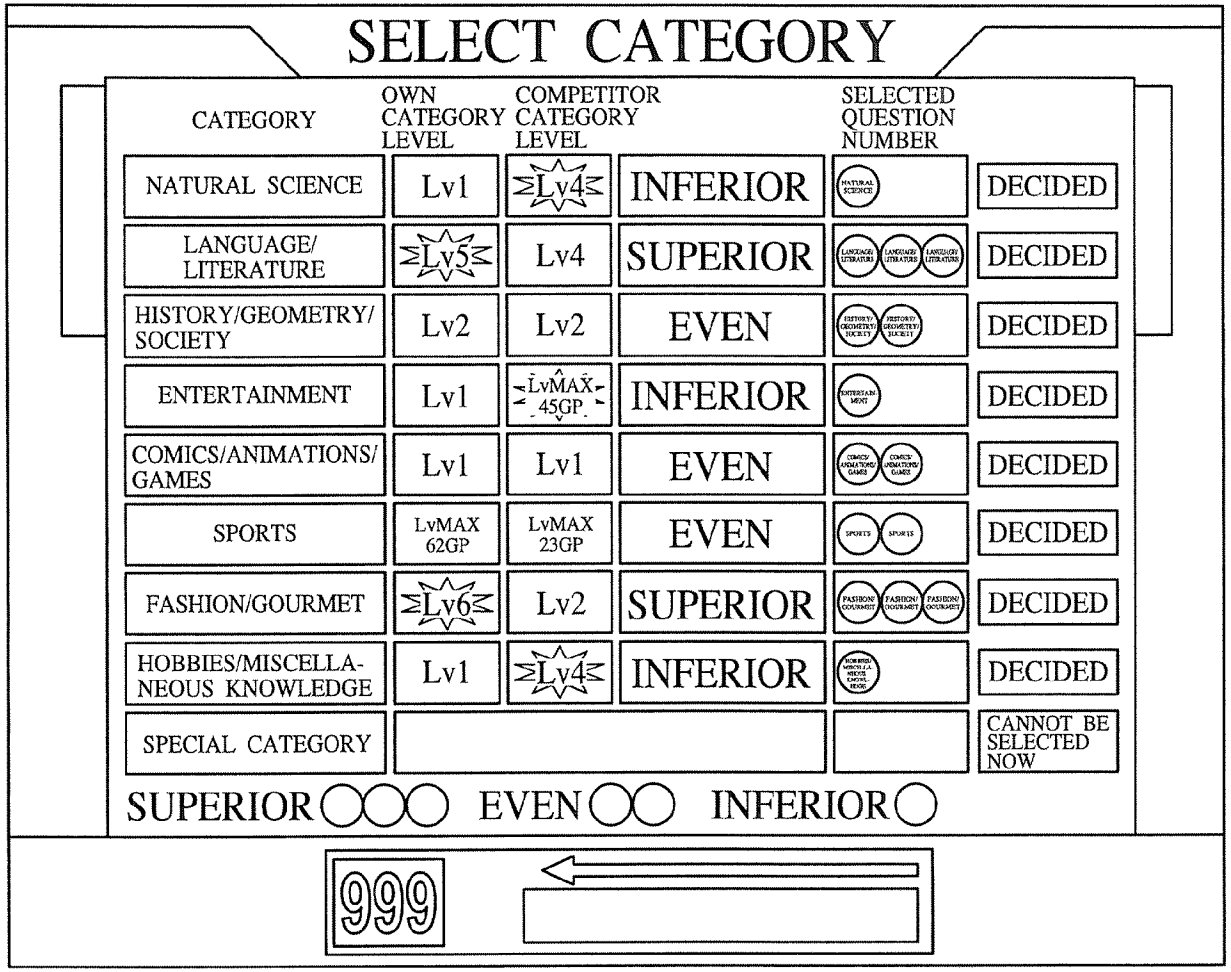
FIG. 23 is a view illustrating the game image of the point handicapped competition processing of the embodiment of the present invention (Part 5).

For example, in the category selection image, as illustrated in FIG. 23, the own category levels and the competitor category levels are indicated in positions opposite to the positions in FIG. 22, and the comparison results and the question-to-be-selected numbers are accordingly different.

As illustrated in FIG. 23, in Natural science category, the own category level is "Level 1", and the competitor category level is "Level 4". The comparison result is "Inferior", and the question-to-be-selected number is "3 questions".

In Language/literature category, the own category level is "Level 5", and the competitor category level is "Level 4". The comparison result is "Superior", and the question-to-be-selected is "3 questions".

In History/geometry/society category, the own category level is "Level 2", and the competition category level is "Level 2". The comparison result is "Even", and the question-to-be-selected is "2 questions".

In entertainments category, the own category level is "Level 1", and the competitor category level is "Level MAX (45 GP)", and the question-to-be-selected number is "1 question".

In Comics/animations/games category, the own category level is "Level 1", and the competitor category level is "Level 1". The comparison result is "Even, and the question-to-be-selected number is "2 questions".

In Sports category, the own category level is "Level MAX (62 GP)", and the competitor category level is "Level MAX (23 GP)", and the comparison result is "Even", and the question-to-be-selected number is "2 questions".

In Fashion/Gourmet category, the own category level is "Level 6", and the competitor category level is "Level 2". The comparison result is "Superior", and the question-to-be-selected number is "1 question.

In Hobbies/Miscellaneous knowledge category, the own category level is "Level 1", and the competitor category level is "Level 2". The comparison result is "Inferior", and the question-to-be-selected number is "1 question".

Figure 24:
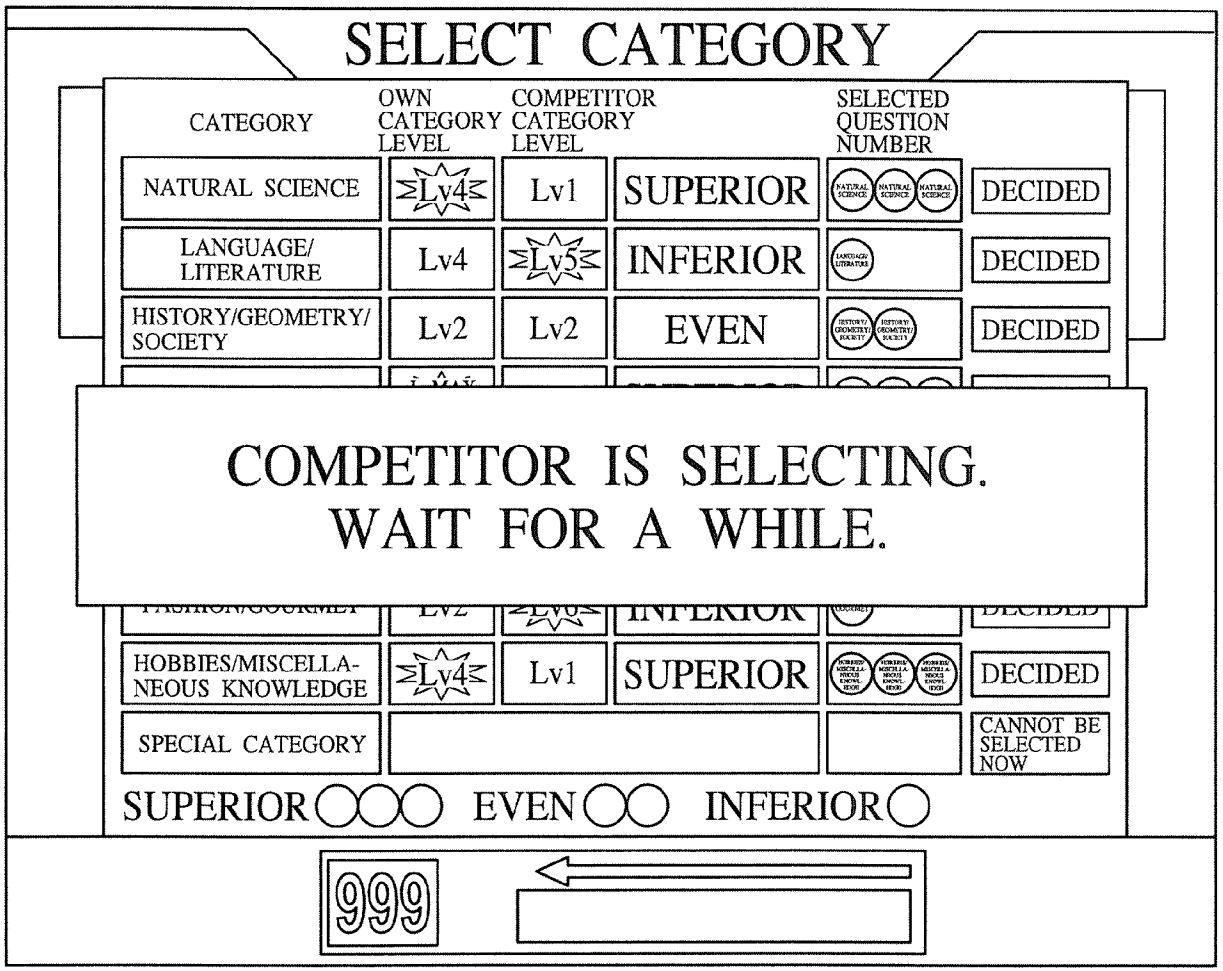
FIG. 24 is a view illustrating the game image of the point handicapped competition processing of the embodiment of the present invention (Part 6).

Next, the master player watches the category selection image of FIG. 24 and touches the decision button of a category he has selected. The master game device 12 detects the category selection by the touch panel 24 and transmits the selected category information to the server 30. The master player has selected here "Natural science category" in which he is superior.

In the same way, the slave player s well watches the same category selection image as in FIG. 24 and touches the decision button of a category he has selected. the slave game device 12 detect the category selection by the touch panel 24 and transmits the selected category information to the server 30. The sale player has selected here "Fashion/Gourmet category" in which he is superior.

When the player has completed the category selection, but the competitor is selecting a category, the image as illustrated in FIG. 24 is displayed to inform the player that the competitor is selecting a category.

Next, the server 30 receives the selected category (Natural science category) transmitted from the mater game device 12 and the selected category (Fashion/Gourmet) transmitted from the slave game device 12, and transmits these selected categories to the master game device 12.

(Question Constitution Deciding Processing)

The master game device 12 receives the selected category (Natural science category) of the master player transmitted from the server 40 and the selected category (Fashion/Gourmet) of the slave player and, based on their superiority and inferiority in the categories, a question constitution is decided.

The master game device 12 prepares in advance the question constitution table 160 as illustrated in FIG. 31A. The question constitution table 160 stores the categories of questions and their characteristics in the order of the question.

The characteristics are special functions given to the respective questions as required. For example, a function is that when an answer is correct, points 1.5 times or 2.0 times a normal point are given.

The question constitution is decided based on the selected category of the master player and the selected category of the slave player. Here, 3 questions of "Natural science category" selected by the master player, and 3 question of "Fashion/Gourmet category" selected by the slave player have been already decided.

The master game device 12 decides a question constitution of, as illustrated in FIG. 31B, 3 questions of "Natural science category" and 3 questions of "Fashion/Gourmet category" arranged so that the former questions and the latter questions can be alternately asked, and questions of "Non-category" added to the end of the thus arranged questions.

The first, the third and the fifth questions are of "Fashion/Gourmet category", and the second, the fourth and the sixth questions are of "Natural science category, and the seventh and the following questions are of "Non-category".

Characteristics are given at random. In FIG. 31B, the privilege of "1.5 times points" is given to the seventh and the tenth questions, and to the eighth and the twelfth questions, the privilege of "2.0 times points" is given.

(Modifications of the Question Constituting Method)

The above-described example of the question constituting method will be generalized, and the generalized method including its modifications will be detailed.

A question of Category A one player has selected is called "A question", and a question of Category B the other player has selected is called "B question". A question of non-category is called "N question".

In the above-described embodiment, when the level of one player is "Superior" in Category A to the level of the other player, "A question" is 3; for "Even", "B question" is 2; and for "Inferior", "B question" is 1.

In the same way, when the level of the other player is "Superior" in Category B to the level of the other player, "B question" is 3; for "Even", "B question" is 2; and for "Inferior", "B question" is 1.

In the above-described embodiment, in the case that "A question" is 3 with the level of one player being "Superior" in Category A to the level of the other player and in the case that "B question" is 3 with the level of the other player is "Superior" in Category B to the level of one player, "A question" and "B question" are alternately asked, and the question constitution is the 1st question="A question", the 2nd question="B question", the 3rd question="A question", the 4th question="B question", the 5th question="A question", the 6th question="B question", the 7th question="N question", the 8th question="N question", the 9th question="N question", the 10th question="N question", . . . .

However, the above-described embodiment is not essential. In the case that "A question" is 3, and "B question" is 3, the sequential order of the questions may be different from that described above. For example, the question constitution can be the 1st question="A question, the 2nd question="B question", the 3rd question="A question", the 4th question="A question", the 5th question="B question", the 6th question=2B question", the 7th question="N question", the 8th question="N question, the 9th question="N question", the 10th question="N question", . . . .

The question constitution can be the 1st question="B question", the 2nd question="A question", the 3rd question="B question", the 4th question="B question", the 5th question="A question", the 6th question="B question", the 7th question="N question", the 8th question="N question", the 9th question="N question", the 10th question="N question", . . . .

The question constitution can be the 1st question="A question", the 2nd question="B question", the 3rd question="B question", the 4th question="A question", the 5th question="A question", the 5th question="B question", the 7th question="N question", the 8th question="N question", the 9th question="N question", the 10th question="N question", . . . .

In the case that the level of one player is "Superior" in Category A, with "A question" being 3, and the level of the other player is "Even" in Category B, with "B question" being 2, the question constitution is, e.g., the first question="A question", the 2nd question="b question", the 3rd question="A question", the 4th question="B question", the 5th question="A question", the 6th question="N question", the 7th question="N question", the 8th question="N question", the 9th question="N question", the 10th question="N question", . . . . The sequential order of the questions is not limited to the above and can be freely modified.

In the case that the level of one player is "Superior" in Category A, with "A question" being 3, and the level of the other player is "Inferior" in "Category B", with "B question" being 1, the question constitution is, e.g., the 1st question="A question", the 2nd question="B question", the 3rd question="A question", the 4th question="A question", the 5th question="N question", the 6th question="N question", the 7th question="N question", the 8th question="N question", the 9th question="N question", the 10th question="N question", . . . . The sequential order of these questions are not essentially the above and can be freely modified.

In the case that the level of one player is "Even" in Category A, with "A question" being 2, and the level of the other player is "Even" in Category B, with "B question" being 2, the question constitution is, for example, the 1st question="A question", the 2nd question="B question", the 3rd question="A question", the 4th question="B question", the 5th question="N question", the 6th question="N question", the 7th question="N question", the 8th question="N question", the 9th question="N question", the 10th question="N question", . . . . The sequential order of the questions is not limited to the above and can be freely modified.

In the case that the level of one player is "Even" in Category A, with "A question" being 2, and the level of the other player is "Inferior" in Category B, with "B question" being 1, the question constitution is, for example, the 1st question="A question", the 2nd question="B question", the 3rd question="A question", the 4th question="N question", the 5th question="N question", the 6th question="N question", the 7th question="N question", the 8th question="N question", the 9th question="N question", the 10th question="N question", . . . . The sequential order of the questions is not limited to the above and can be freely modified.

In the case that the level of one player is "Inferior" in Category A, with "A question" being 1, and the level of the other player is "Inferior" in Category B, with "B question" being 1, the question constitution is, for example, the 1st question="A question", the 2nd question="B question", the 3rd question="N question", the 4th question="N question", the 5th question="N question", the 6th question="N question", the 7th question="N question", the 8th question="N question", the 9th question="N question", the 10th question="N question", . . . . The sequential order of the questions is not limited to the above and can be freely modified.

In the above-described embodiment, in the case that the level is "Superior", the question in the associated category is 3, when the level "Even", the question in the associated category is 2, and in the case that the level is "Inferior", the question in the associated category is 1. However, the number of questions is not limited to the above.

Furthermore, not only the question number but also the difficulty of the questions may be differed.

(Details of Competitive Game Processing)

Subsequently, the competitive game processing will be detailed with reference to the flow hart of FIG. 32.

(Question Constitution Display Processing)

When the master game device 12 (Step B06) has decided a question constitution (Step B06), the master game device 12 transmits the decided question constitution table 160 to the server 30 (Step B11). The server 30 receives the question constitution table 160 transmitted by the master game device 12 and transmits the question constitution table 160 to the master game device 12 and the slave game device 12 (Step C11).

The master game device 12 receives the question constitution table 160 transmitted by the server 30 and displays the question constitution table 160 on the display monitor 34 (Step B11).

Figure 25:
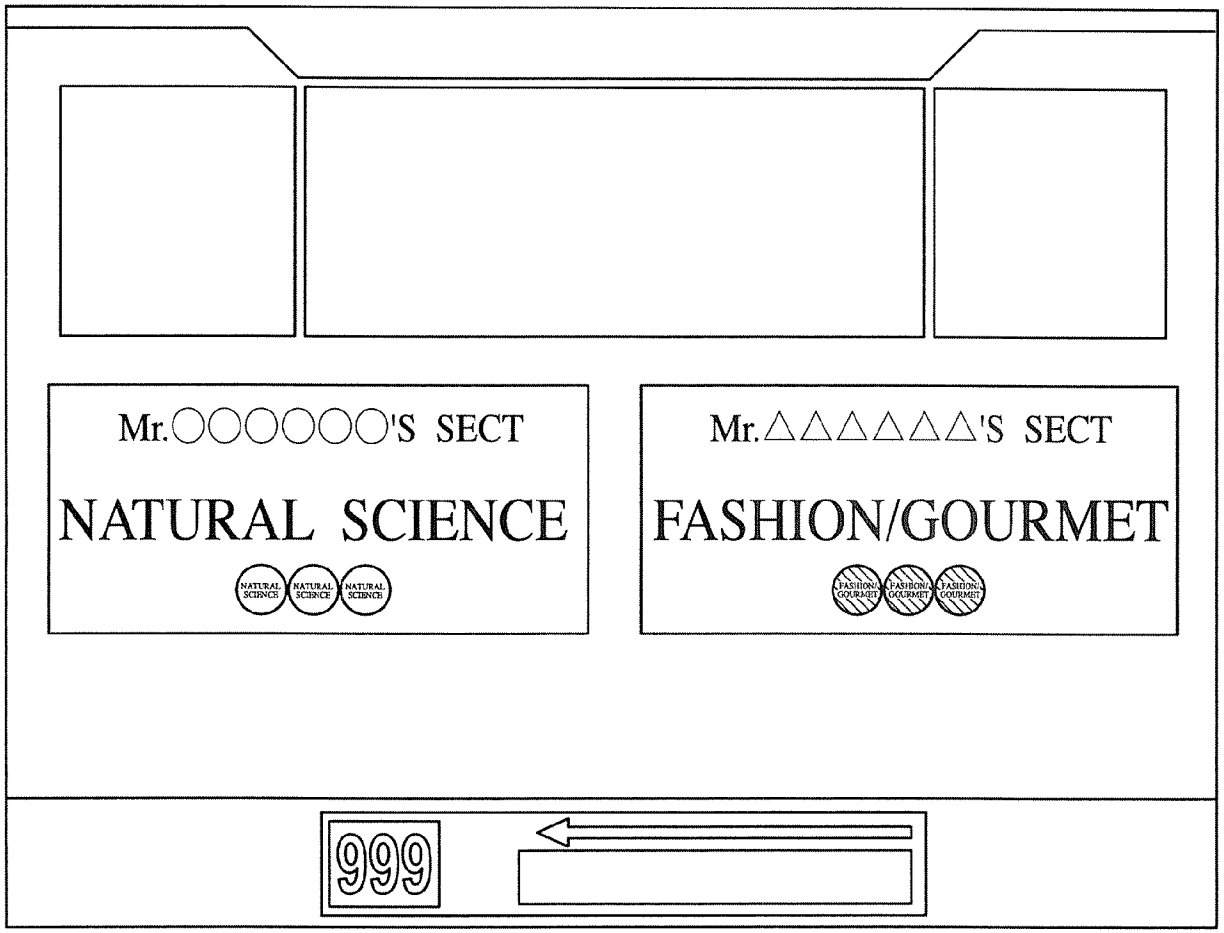
FIG. 25 is a view illustrating the game image of the point handicapped competition processing of the embodiment of the present invention (Part 7).
Figure 26:
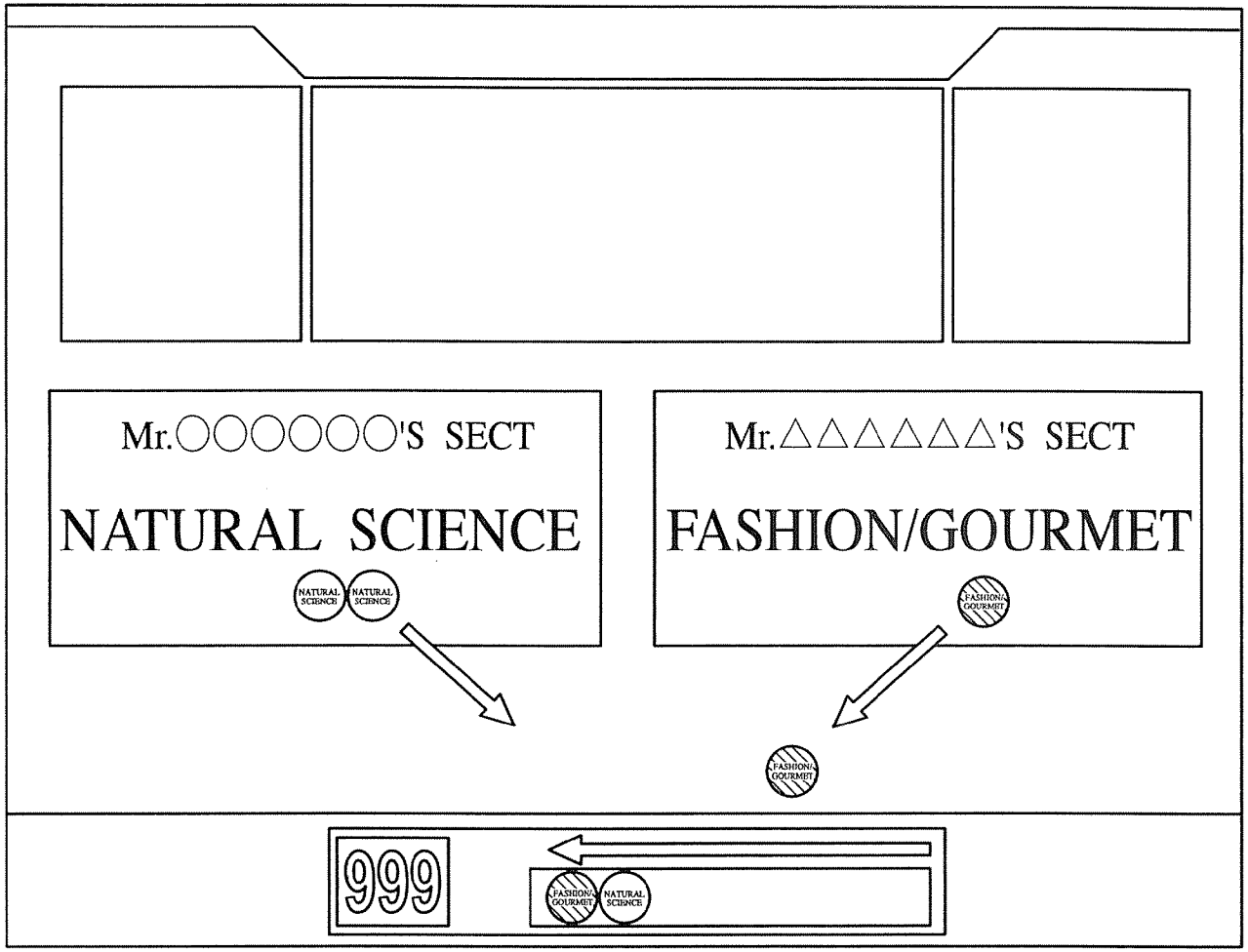
FIG. 26 is a view illustrating the game image of the point handicapped competition processing of the embodiment of the present invention (Part 8).
Figure 27:
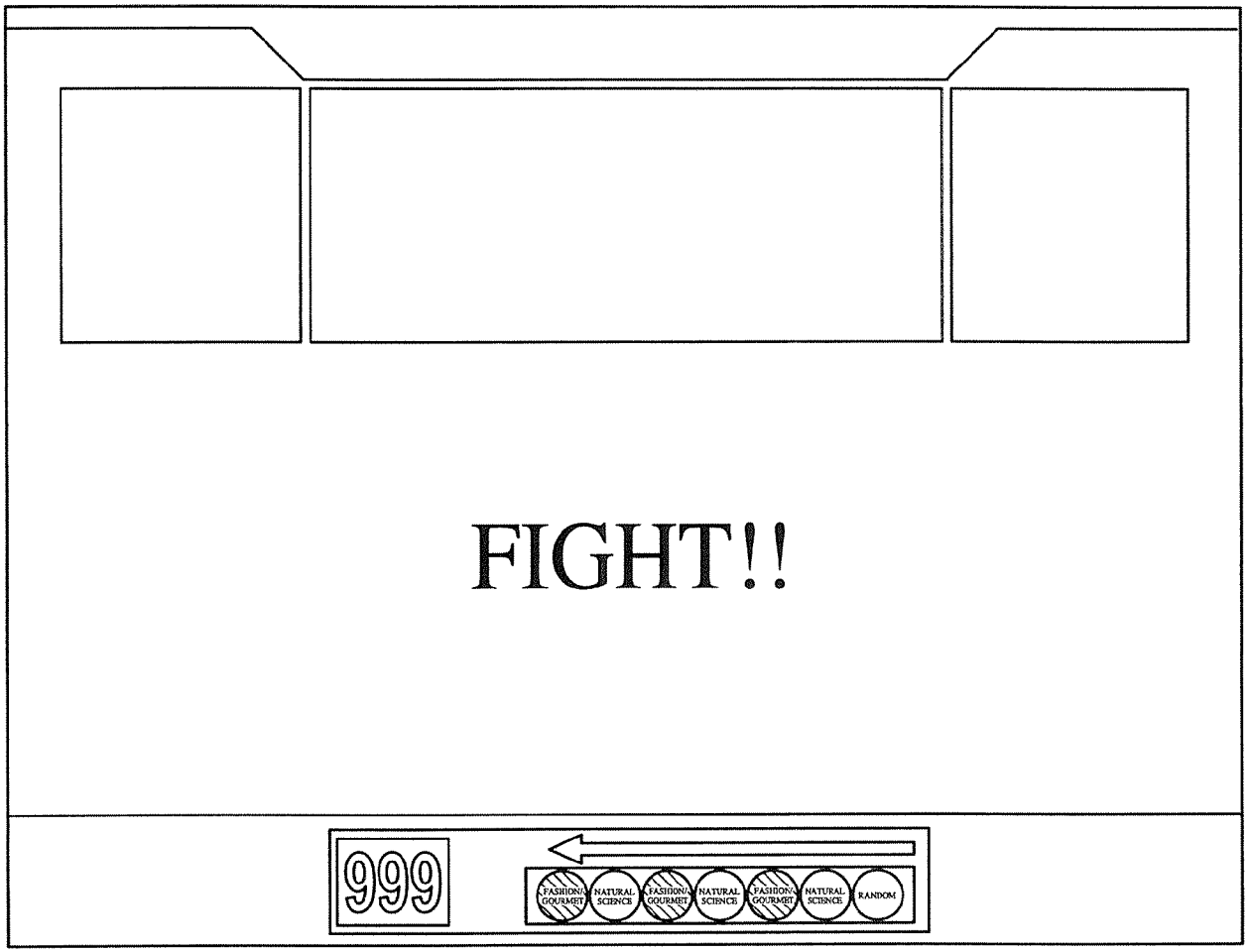
FIG. 27 is a view illustrating the game image of the point handicapped competition processing of the embodiment of the present invention (Part 9).

At this time, as illustrated in FIGS. 25 to 27, the process of deciding the question constitution is effectively displayed.

First, as illustrated in FIG. 25, at the center of the image on the display monitor 34, about respective 2 competitive players, their names, selected categories and the question balls are indicated. On the right of the center of the image, "Natural science" and 3 question balls are indicated in the display frame which is "Mr. OOOO's select. In the display frame which is the "Mr. Δ Δ Δ Δ's select, "Fashion/Gourmet" and 2 question balls are indicated.

The method of indicating question balls will be explained with reference to FIG. 30. One question ball indicates 1 question. A category is indicated on a question ball.

Figure 30A:
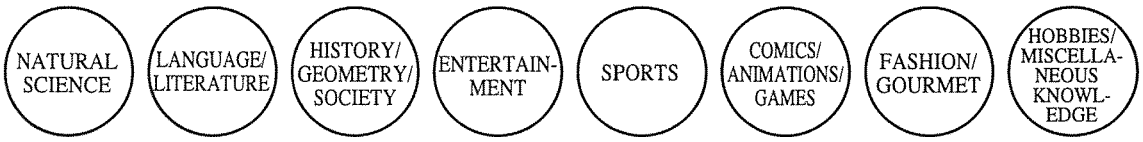
FIG. 30 is views illustrating the question balls of the competition game processing according to the embodiment of the present invention.

FIG. 30A illustrates category balls which are questions given by one player having selected categories. On the category balls, the categories (Natural science, language/literature, History/geometry/society, Entertainments, Comics/animations/games, Sports, Fashion/Gourmet, Hobbies/Miscellaneous knowledge) are indicated.

Figure 30B:
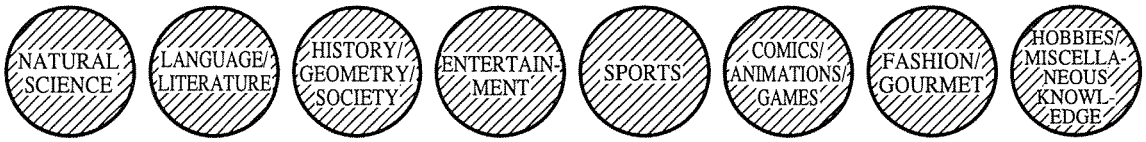

FIG. 30B illustrates category balls which are questions given by the competitor having selected categories. The category balls are hatched, and on the category balls, categories (Natural science, Language/literature, History/geometry/society, Entertainments, Comics/animations/games, Sports, Fashion/Gourmet, Hobbies/Miscellaneous knowledge) are indicated.

Figure 30C:
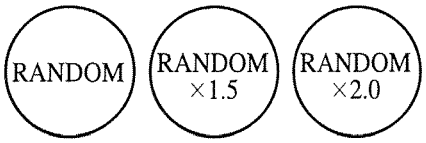

FIG. 30C illustrates other balls. Some of them represent random questions. On the balls having characteristics, the contents of the characteristics "'x1.5", "x2.0", etc.) are indicated.

Then, as illustrated in FIG. 26, motions of the displayed question balls being alternately thrown into the question box at the lower part of the image on the display monitor 34 are displayed. The question balls of "Fashion/Gourmet" and the question balls of "Natural science" are alternately thrown into the question box.

Finally, as illustrated in FIG. 27, the decided question constitution is indicated by the row of the question balls in the question box at the bottom of the image. The question balls are arranged in the order of "Fashion/Gourmet", "Natural science", "Fashion/Gourmet", "Natural science", "Fashion/Gourmet", "Natural science", "Non-category", . . . in the question box so that the question constitution of the question constitution table of FIG. 31B is formed.

The slave game device 12 as well receives the question constitution table 160 from the server 30 and displays the question constitution table 160 on the display monitor 34 (Step D05). The slave game device 12 as well as the master game device 12 effectively displays the process of deciding the question constitution as illustrated in FIGS. 25 to 27.

(Question Presentation Processing)

Then, the master game device 12 transmits the next question to the server 30, based on the decided question constitution table 160 (Step B12). The server 30 receives the next question transmitted by the master game device 12 and transmits the next question to the master game device 12 and the slave game device 12 (Step C12).

The master game device 12 receives the next question transmitted by the server 30 and indicates the next question on the display monitor 34 (Step B12).

Figure 28:
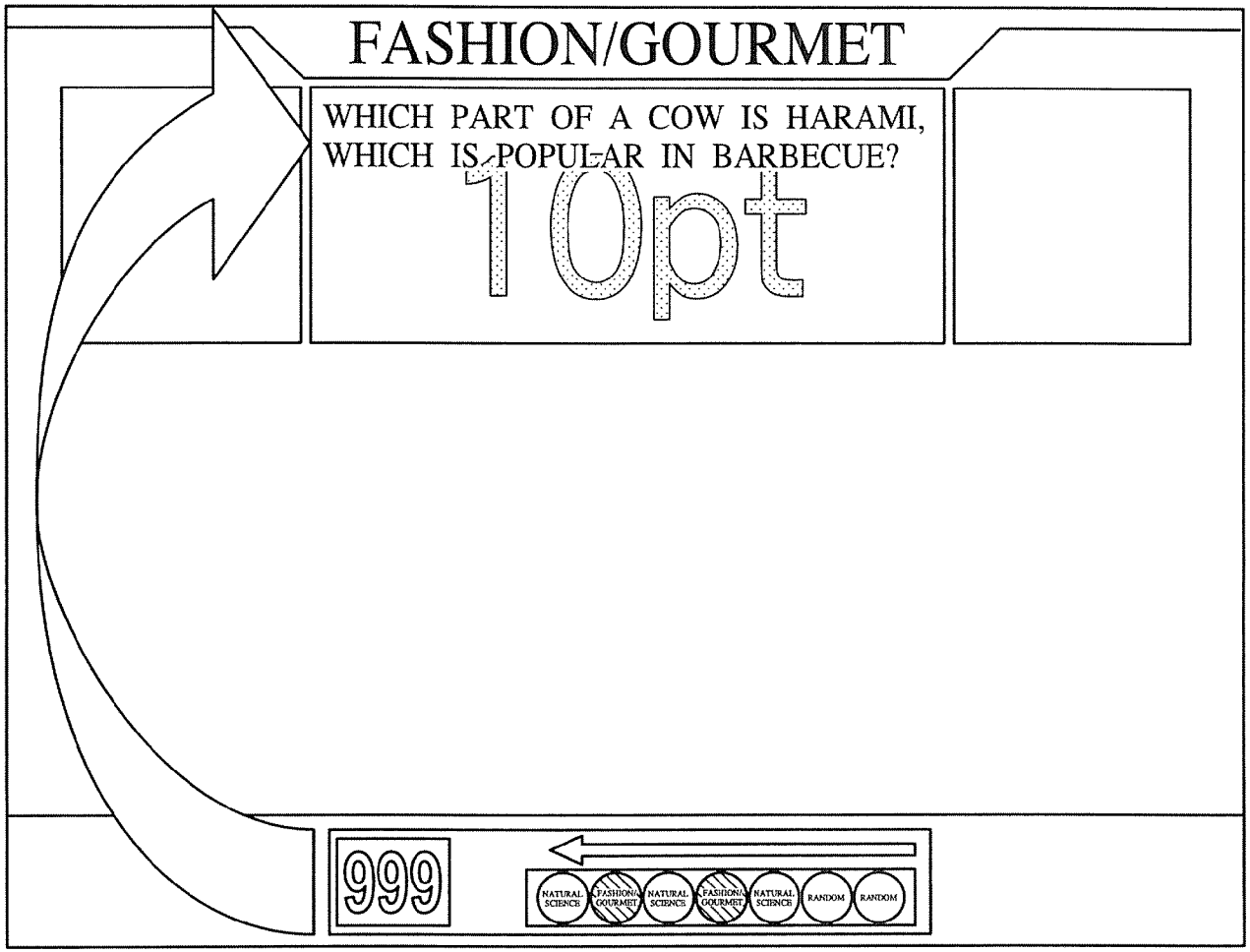
FIG. 28 is a view illustrating the game image of the point handicapped competition processing of the embodiment of the present invention (Part 10).
Figure 29:
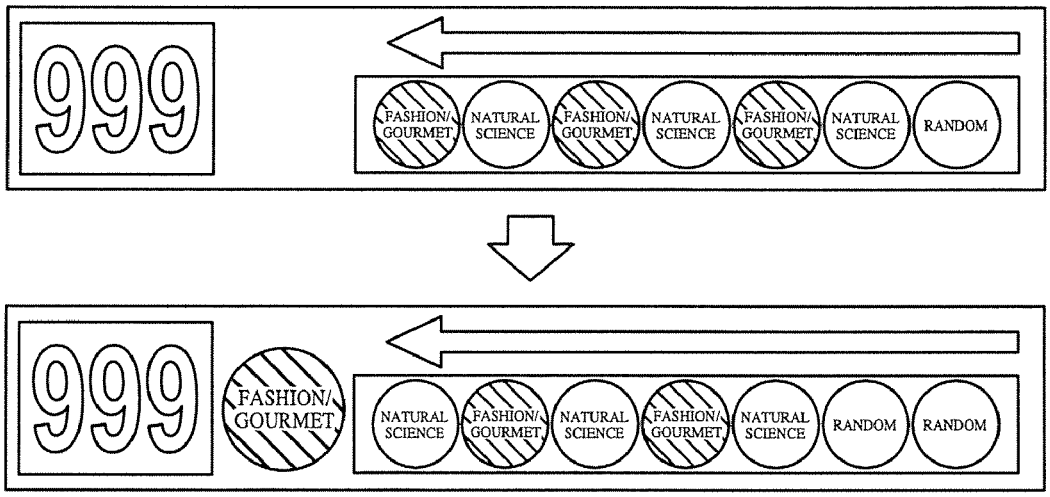
FIG. 29 is a view illustrating the game image of the point handicapped competition processing of the embodiment of the present invention (Part 11).

At this time, as illustrated in FIGS. 28 and 29, the presentation of the question is effectively displayed. The question ball (Fashion/Gourmet) at the leftest end flies out of the question box at the bottom of the image on the display monitor 34 into the question sentence region at an upper part of the image, and the question sentence is indicated. The question ball row in the question ball box shift left. In the question sentence region, "Which part of a cow is harami, which is popular in barbecue?" is indicated (Step D12), and the arrangement of the question balls in the question box shifts to "Natural science", "Fashion/Gourmet", "Natural science", "Fashion/Gourmet", "Natural science", "Non-category" and "Non-category". FIG. 29 illustrates the shift in the question box upon the question presentation.

The slave game device 12 as well receives the next question transmitted by the server 30 and indicates the next question on the display monitor 34 (Step D12). The slave game device 12 as well as the master game device 12 effectively displays the next question as illustrated in FIG. 28.

(Answering Right Deciding Processing)

Next, the master player reads the question indicated on the display monitor 34 and pushes the execution button when he knows the answer (Step A11).

The master game device 12 measures a button push time, based on the push-down of the execution button 28 by the player (Step B13). The button push time is measured by measuring a period of time from the presentation of the question to the push of the execution button 28 with the local timer of the master game device 12.

Then, the master game device 12 transmits the measured button push time to the server 30 (Step B13).

In the same way, the slave player as well reads the question indicated on the display monitor 34 and pushes the execution button 28 when he knows the answer (Step E11).

The slave game device 12 measures the button push time, based on the push-down of the execution button by the player (Step D13). The button push time is measured by measuring a period of time from the presentation of the question to the push of the execution button 28 with the local timer of the slave game device 12.

Then, the slave game device 12 transmits the measured button push time to the server 30 (Step D13).

Then, the server 30 receives the button push time of the master player transmitted from the master game device 12 and the button push time of the slave player transmitted from the slave game device 12 and transmits them to the master game device 12 (Step C13).

Next, the master game device 12 receives from the server 30 the button push time of the master player and the button push time of the slave player, compares them, and gives the answering right to the player whose button push period of time is shorter (Step B14). For the explanation, the slave player has obtained the answering right here.

Then, the master game device 12 transmits the decided answering right of the slave player to the server 30 (Step B15). The server 30 receives from the master game device 12 the answering right of the slave player and transmits it to the master game device 12 and the slave game device 12 (Step C14).

The master game device 12 receives the answering right of the slave player transmitted from the server 30 and indicates no answering right on the display monitor 34 (Step B15).

The slave game device 12 receives the answering right of the slave player transmitted from the server 30 and indicates the answering right on the display monitor 34 (Step D15).

(Answering Processing)

Then, the slave player answers the presented question, based on the answering right given (Step E12). The answering method varies depending on the categories of the questions, and the answering method will not be detailed.

The slave game device 12 transmits the answer of the slave player to the server 30 (Step D15). The server 30 receives the answer transmitted from the slave game device 12 and transmits the answer to the master game device 12 (Step C15).

When the master player has obtained an answering right, the master player answers the presented question, based on the given answering right (Step A12). The master game device 12 transmits the answer of the master player to the server 30 (Step B16). The server 30 receives the answer from the master game device 12 and transmits the answer to the master game device 12 (Step C15).

Next, the master game device 12 receives the answer transmitted by the server 30 and judges whether the answer is correct or incorrect, based on the question data base 150 (Step B17).

Next, the master game device 12 transmits to the server 30 the judged correctness or incorrectness of the answer (Step B18). The server 30 receives the correctness or incorrectness of the answer transmitted by the master game device 12 and transmits it to the master game device 12 an the slave game device 12 (Step C16).

The master game device 12 receives the correctness or incorrectness of the answer transmitted by the server 30 and indicates the correctness or incorrectness of the answer on the display monitor 34 (Step D16).

The slave game device 12 receives the correctness or incorrectness of the answer transmitted by the server 30 and indicates the correctness or incorrectness on the display monitor 34 (Step D16).

(Competition Ending Processing)

Then, the master game device 12 judges whether or not the competition time has ended, based on a time pass measured by a tine for measuring the competition time (Step B19).

When the competition time ahs not yet passed, the processing returns to Step B12, and the question presentation processing and the answering processing for the next question are executed in the same way.

When it is judged that the competition time has ended, the master game device 12 compares a correct answer umber of the master player and a correct answer number of the slave player with each other and decides the win and loss with the player having a larger correct answer number as the winner (Step B08).

(Details of Category Handicapped Competition Processing)

Figure 34:
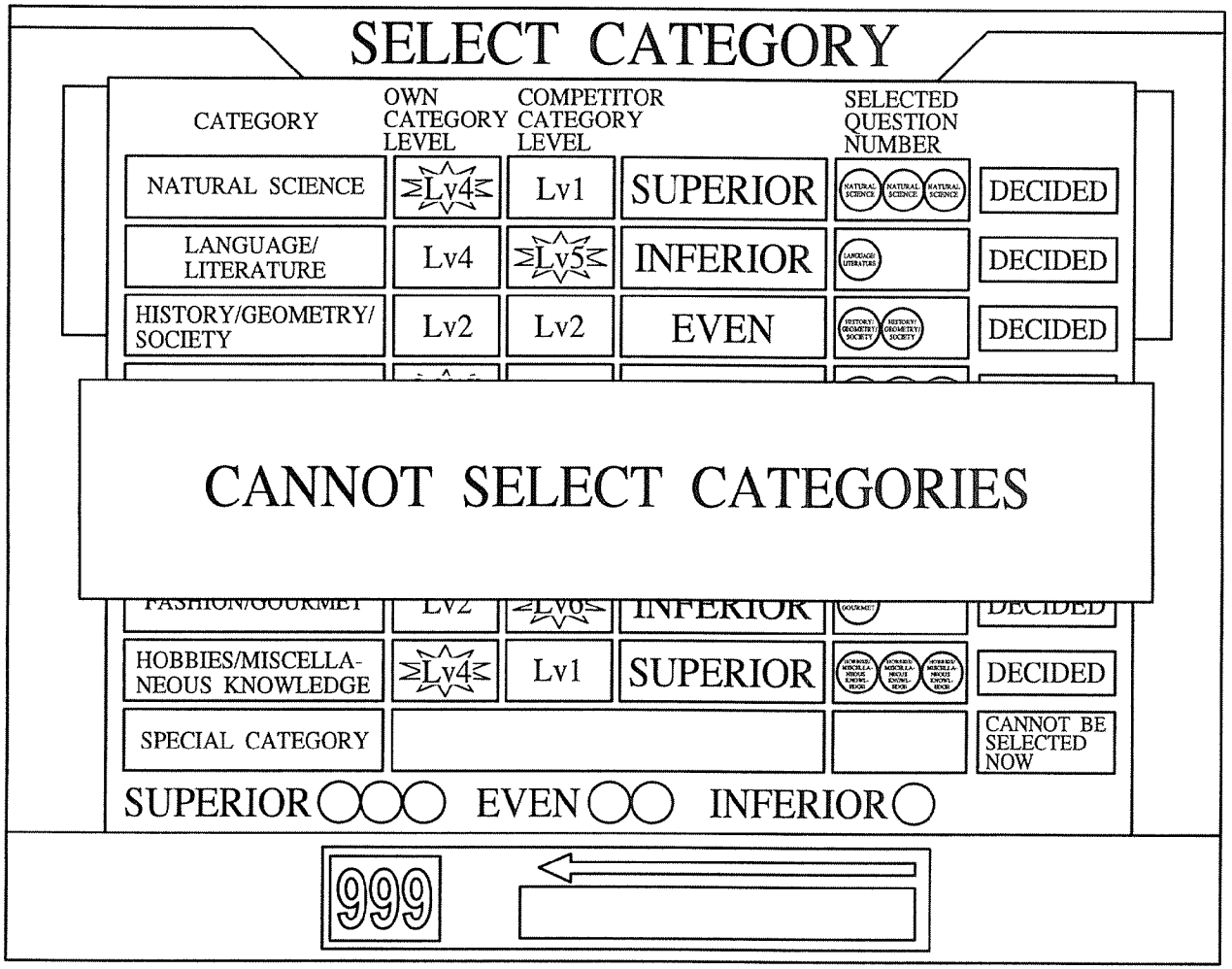
FIG. 34 is a view illustrating the game images of the category handicapped competition processing of the embodiment of the present invention (Part 2).
Figure 35:
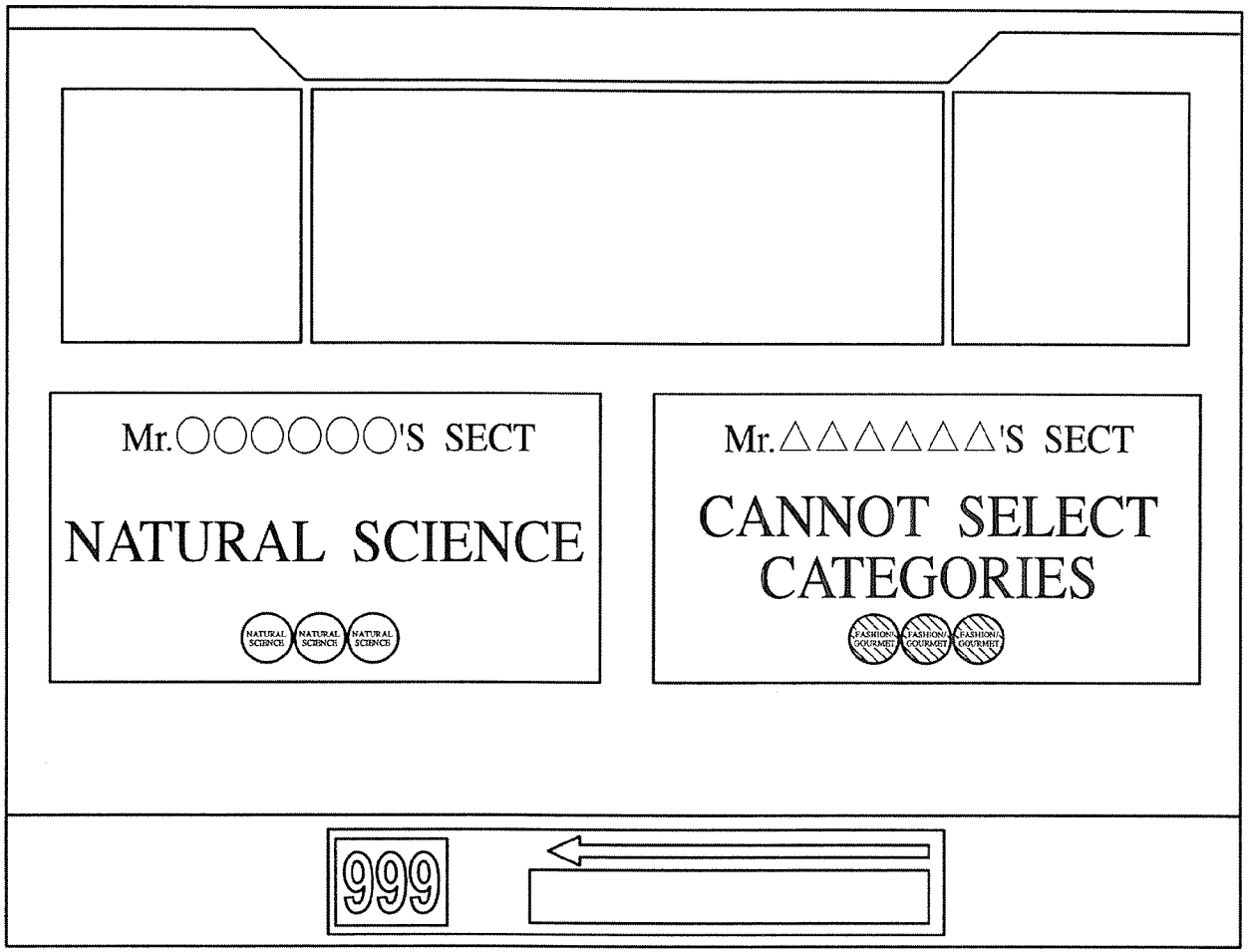
FIG. 35 is a view illustrating the game images of the category handicapped competition processing of the embodiment of the present invention (Part 3).

The category handicapped competition processing of the game system according to the present embodiment will be detailed with reference to FIGS. 33 to 35. FIGS. 33 to 35 are views illustrating the game images of the category handicapped processing.

The category handicapped competition is a handicapped competition in which the higher-rank player is prohibited from selecting a category. The point of the higher-rank player and the point of the lower-rank player at the start of the game is equal.

Figure 33A:
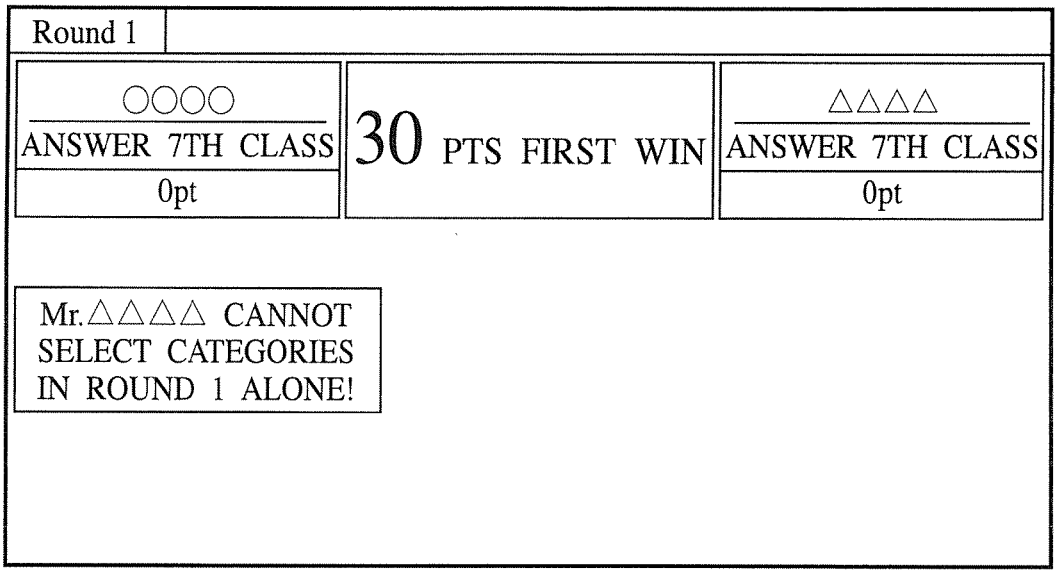
FIG. 33 is views illustrating the game images of the category handicapped competition processing of the embodiment of the present invention (Part 1).

Before the game competition is started, first the game image indicating that the category handicapped competition is to be made as illustrated in FIG. 33A is displayed on the display monitor 34 of the lower-rank game device 12. At the upper central part of the game image, it is indicated that the player who has won 30 points in advance wins the game, and on the left of the game image, the letters "Mr. cannot select categories only in ROUND 1!" are indicated.

Figure 33B:
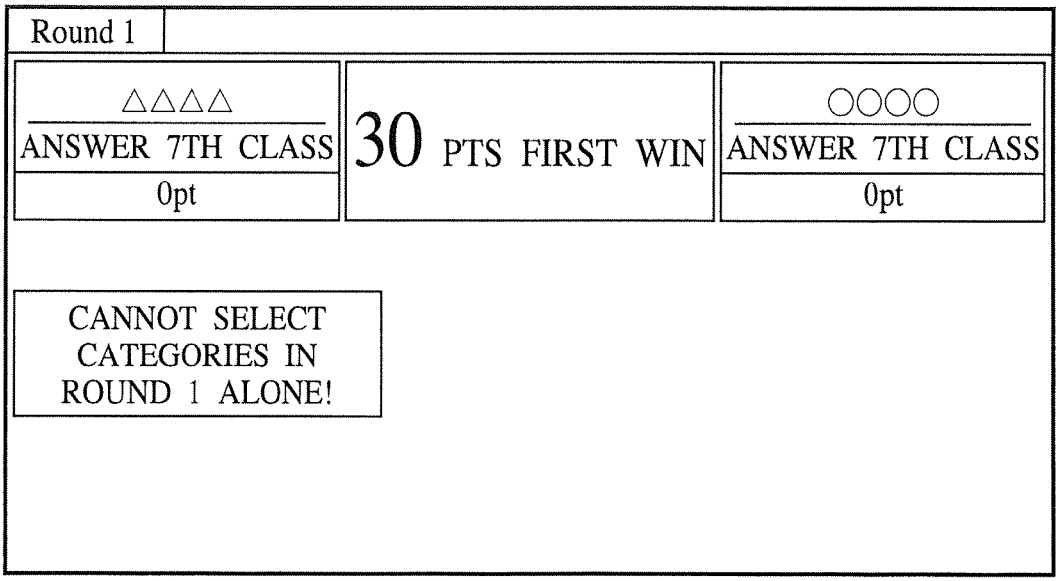

On the display monitor 34 of the higher-rank game device 12 as well, the game image indicating that the category handicapped competition is to be made, as illustrated in FIG. 33B is displayed. At the upper center of the game image, it is indicated that the player who has won 30 points in advance wins the game, and on the left of the game image, the letters "Categories cannot be selected only in ROUND 1!" are indicated.

The category handicapped competition processing is the same as the above-described point handicapped competition processing in the basic competition processing except the category selection processing.

In the category selection processing, the higher-rank player is prohibited from selecting categories. That is, when categories are selected, the game image indicating categories cannot be selected, as illustrated in FIG. 34 is displayed on the display monitor 34 of the game device 12 of the higher-rank player. At the center of the game image, the letters "Categories cannot be selected." are indicated, and the touch input with the touch panel 24 cannot be made.

Then, when the lower-rank player has completed the category selection, the game image as illustrated in FIG. 35 is displayed.

For the lower-rank player, the name of the player, selected categories and the question balls are indicated. "Natural science" and 3 question balls are indicated in the indication frame indicating "Mr. OOOO's select".

For the higher-rank player, who is has been prohibited from selecting categories, the name of the player alone is indicated. In the display frame indicating "Mr. Δ Δ Δ Δ's select", the letters "Categories cannot be selected." are indicated.

In the category handicapped competition, in which the category selection by the higher-rank player is prohibited, in the normal competition, the question constitution is formed of questions of Non-category, for example, in place of questions of categories selected by the higher-rank player.

(Image Effecting Rank Shift)

As a result of a competition by 2 players, depending on the win and loss, often their ranks are changed. In such case, when the win and loss of the competition is decided, the rank change is indicated by effective image.

Figure 36:
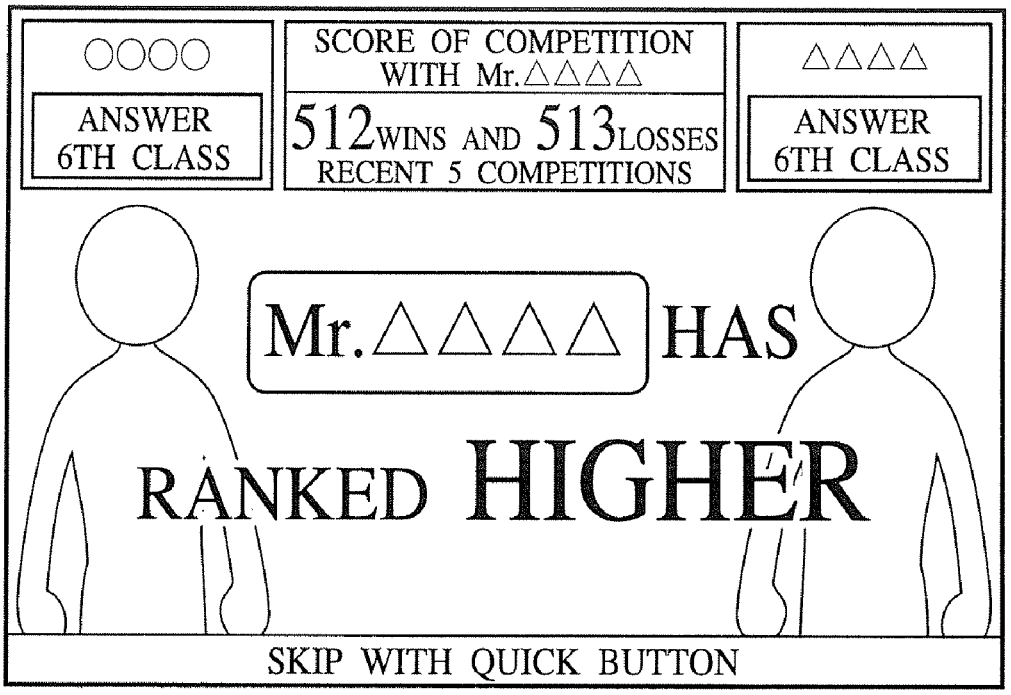
FIG. 36 is a view illustrating an effective image of a rank shift of the competition game processing of the embodiment of the present invention.

One example of the effective image is illustrated in FIG. 36. As a result of the win of Mr. OOOO, the competition score of Mr. OOO is shifted from 512 wins vs. 512 losses to 512 wins vs. 513 losses, and Mr. is ranked higher. At the center of the game image, the letters "Mr. Δ Δ Δ Δ has ranked higher." are effectively indicated.

The changed rank is stored in the respective "Rank" columns of the player data table 130 of FIG. 6A and the competitive player data table 140 of FIG. 6B.

(Details of Win and Loss Storing Processing)

Figure 37:
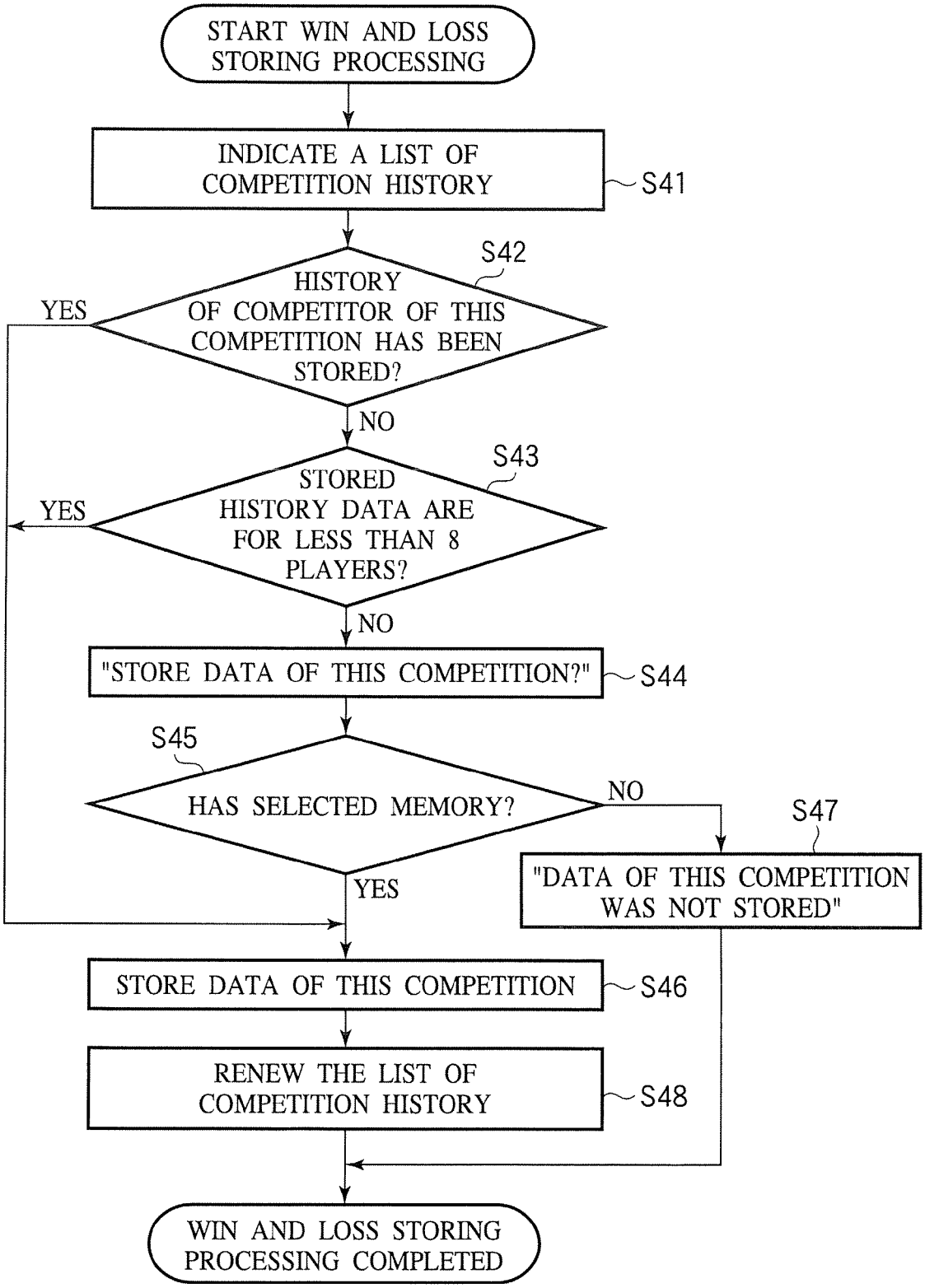
FIG. 37 is the flow chart of the win and loss storing processing of the embodiment of the present invention, which details the win and loss storing processing.
Figure 38:
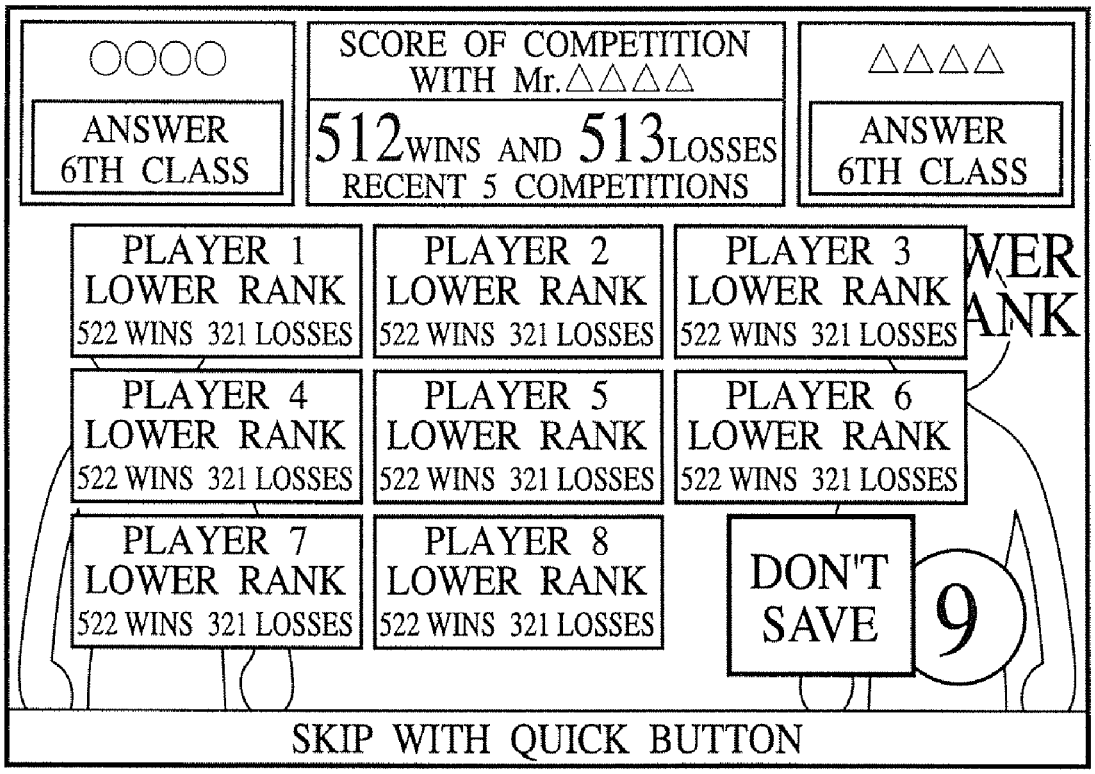
FIG. 38 is a view illustrating the game image of the win and loss storing processing of the embodiment of the present invention.

The win and loss storing processing of the game system according to the present embodiment will be detailed with reference to FIGS. 37 and 38. FIG. 37 is the flow chart of the win and loss storing processing which illustrates the details thereof. FIG. 38 is a view of a game image of the win and loss storing processing.

When 2 players have completed the game competition processing, the win and loss storing processing for storing the result of the competitive game in the master-game device 12 and in the slave game device 12 is made.

First, on the display monitor 34 of the game devices 12, the game image indicating a list of the competition history, as illustrated in FIG. 38 is indicated. At the center of the game image, 8 storage command buttons, and 1 non-storage command button are displayed (Step S41).

The 8 storage command buttons correspond to the "Play History" columns of 8 players in the player game data table 130 of FIG. 6. When data are stored in the "Play History" columns of the player game data table 130, the player names, the ranks and the competition scores are indicated in the storage command buttons. When not data are stored, "No data", for example, is indicated. In the non-storage command button, the letters "Not stored" are indicated.

Next, the game device 12 judges whether or not the histories of the competitors of this competition are stored (Step S42). When stored, the data of this competition are stored (Step S46).

When not stored, it is judged whether the present stored history data are for below 8 players excluding 8 players (Step S43). When the present stored history data are for below 8 players excluding 8 players, the data of this competition are stored (Steep S46).

When the present stored history data are for 8 or more players, the letters "Store the data of this competition?" are indicated on the game image of FIG. 38, and the game device 12 waits for the playership command of a column for the data to be stored in (Step S44).

When one of the 8 storage command buttons is selected by the player (Step S45), the data of this competition are stored in the "Play History" column corresponding to the selected storage command button (Step S46). The list of the competition histories is renewed (Step S48), and the win and loss storing processing is completed.

When the player selects the non-storage command button is selected (Step S45), the letters "Data of this competition was not stored." are indicated on the game image of FIG. 38, and the win and loss storing processing is completed.

[Modified Embodiments]

The present invention is not limited to the above-described embodiment and can cover other various modifications.

For example, in the above-described embodiment, the present invention is explained by means of the game system including game devices installed in amusement facilities connected with networks. The principle of the present invention is applicable to domestic game devices including means which communicate with a server via a network, personal computers, or portable telephones, such as portable telephones, PHS, PDA, etc.

In the above-described embodiment, the present invention is explained by means of a game system in which players operate respective game devices to compete. However, the present invention is applicable to controlling a game device which is operated by 2 players for the competition. That is, the present invention is applicable to a single game device which is operated with a plurality of inputs without using a server, or a plurality of game devices directly connected to each other for the competition.

In the above-described embodiment, IC cards are used to identify players, but magnetic card, pass cards, Suica cards, Edy cards, portable telephones, etc. may be used. Means, such as fingerprints, irises or others, which identify individuals may be used as long as they can identify players.

In the above-described embodiment, the game is a competitive game in which 2 players compete 1 vs. 1. However, the game can be a competitive game in which a plural of players make a team to compete a team vs. a team.

In the above-described embodiment, levels of a player for the respective categories are stored in the IC card or the player data table and questions to be presented are decided based on the level read therefrom. However, it is possible that live data, etc., such as category points, correct answer rates, correct and incorrect answers are stored in the IC card and the player data table, and every time the level information is necessary to advance the game, e.g., every time the IC card is read, players compete, etc., levels are computed by a prescribed computation formula.

In the above-described embodiment, the categories of the questions are classified in natural science, language/literature, history/geometry/society, etc., based on the contents of the questions. However, the categories may be classified based on question presenting forms, such as the panel quiz, the typing quiz, the 4 choices quiz, etc. For the non-category, questions of one selected at random out of various question presenting forms are presented.

In the above-described embodiment, the present invention is applied to a quiz game but is applicable to games of other categories, e.g., fighting games, race games, Tetris game, mah-jongg, poker, etc.

In the above-described embodiment, as handicaps of the quiz game, the category selection of the strong player (higher-rank player) is restricted, and pints are given to the weak player (lower-rank player) at the start of the game. However, these are not essential.

For example, as another handicap, in competition games, such as race games, action games, fighting games, etc. in which players compete in the techniques of operating characters, "the handicap of differing efficiencies of the characters" is considered.

As the handicap of differing the efficiencies of characters", the following handicaps are considered for competitive fighting games (in which the success of performances is judged between an enemy character and an own character; when an attack is successful, the physical force of the counterpart is decreased, and the character who has lost the physical force loses.

(a) The character of the weak player has the attacking force of a part or all the performances made higher than the character of the strong player. The attacking force of the character of the weak player may be raised, or the attacking force of the character of the strong player may be lowered.

(b) The character of the weak player has the physical force increased than the character of the strong player. The physical force of the character of the weak player may be increased, or the physical force of the character of the strong payer may be decreased. The ratio of the increase and decrease of the physical force may be varied with a difference of the win rates of the competition scores.

(c) The character of the strong player cannot use a part of the performances; for example, only close performances (performances used when the characters come near) alone can be used, the use of surely killing performances (performances giving fatal damages to the counterpart) is prohibited, etc.

As "Handicaps for differing the efficiency of characters", the following handicaps are considered for race games (in which players compete in who arrives earlier at the goal point from the start point), such as race games, athletic games, etc.

(a) The car (character) of the weak player is superior to the car (character) of the strong player in efficiencies of the car (the maximum speed, acceleration, grip force, etc.)

(b) The car of the strong player is heavier than the car (character) of the weak player, which reduces the maximum speed of the car and exhausts the car earlier.

As another handicap, for example, the handicap "The win conditions are differed." is considered.

The handicap will be exemplified as follows.

(a) The weak player gets 1 win so as to win the game, but the strong player must 2 wins so as to win the game.

(b) The physical force of the strong player goes on decreasing as time passes.

(c) The limit time of the strong player and that of the weak player are different from each other; the time lit of the strong payer is 30 seconds, but the limit time of the weak player is 1 minute, etc.

(d) The strong player must make the physical force of the counterpart zero so as to win the game, but the weak player can win by succeeding in making performances prescribed number of times even if the counterpart has a physical force residue.

(e) The strong player must not only win the race with the counterpart but also satisfy prescribed conditions so as to win the game, but the weak player only wins the race with the counterpart so as to win the game.

For example, in mah-jongg, the weak player may win 5 times by premature winning even with the winning hand of cheap Tempai (1 set missed for a win), but the strong player must win 3 times with Mangan (a limit hand); the strong player must get required points or more.

For example, in the baseball game, soccer game, etc., the weak player can win when he gets 1 point, whatever low his score is, but the strong player must win by getting higher scores than the counterpart, etc.

For example, as other handicaps, the handicap "Environments of the game are differed" is considered. For example, the following handicaps are considered.

(a) In the race game, the weak player can start at a position nearer to the goal than strong player. The distance at which the weaker player can start may be varied with the competition scores.

(b) In the race game, the weak player can start earlier by a prescribed time than the strong player. Prescribed times, e.g., 1 minute, 2 minutes, etc. for the start may be varied with the competition scores.

(c) In the race game, the weak player can run in environments which make his run easier than the run of the strong player. For example, in the race game, the weather of the course of the weak player is clear, but the course of the strong player is rainy and has the view obstructed and slippery, etc.

In the above-described embodiment, the strong player accepts a handicap proposed by the weak player, and the handicapped competition is realized. To make the handicaps acceptable to the strong player, the following is considered.

(a) Wins and losses of handicapped competitions and winds and losses of the normal competitions are stored separately, and they can be inspected.

The strong player has stronger consciousness that winning in the normal competitions without handicaps is more valuable, and the wins and losses of the handicapped competitions are treated as independent scores, which makes the handicaps acceptable to the strong player.

(b) The strong player is given corresponding bonuses when he accepts a handicapped competition or when he accepts a handicapped competition and wins in the handicapped competition, etc.

For example, in the medal game, a special payment is made, based on points given by winning a handicapped competition.

In the fighting game, race game, etc., special items accessories of characters, etc.) can be given by winning handicapped competitions. Preferably, the accessories to be given in games of the type that techniques of operating characters are not items which enforce the competitive efficiencies of the characters but which change the appearances of the characters. The enforcement of the competitive efficiency of the characters makes more difficult for the weak player to win the strong player.

In the above-described embodiment, the present invention is applied to competitive games in which 2 players compete. However, the present invention is applicable to games in which a plurality of players, 2 or more players compete. It is possible that one of the plural players presents a handicap to the rest players, and the rest players select whether or not they accept the handicap.

What is claimed is:

1. A game system for executing a competition game in which a plurality of players compete comprising:

a competition score storing unit which stores competition scores of competitions of one player with the other players with respect to each of the other players;

a handicap information storing unit which stores handicap information of a plurality of handicaps which vary a difficulty of winning the competition game for said one player vs. a competitor;

a matching control unit which matches one of the other players as a matched competitor with said one player, based on a competition request input of said one player;

a rank deciding unit which reads the competition score of said competitor from the competition score storing unit, and, based on the competition scores, judges whether the rank of said one player is higher or lower than the rank of said matched competitor and the rank difference between said one player and said matched competitor;

a handicap selecting unit which, based on the rank difference, decides a plurality of handicaps which can be set in the competition game, presents the decided plurality of handicaps to the lower rank one of said one player and matched competitor, and permits the lower rank one of said one player and matched competitor to select one from the presented plurality of handicaps;

a handicap deciding unit which presents to the higher rank one of said one player and matched competitor the handicap selected by the lower rank one of said one player and matched competitor, and permits the higher rank one of said one player and matched competitor to decide whether or not the higher rank one of said one player and matched competitor accepts the selected handicap; and a handicap setting unit which reads the handicap information corresponding to the handicap decided by the handicap deciding unit from the handicap information storing unit and, based on the handicap information, sets the handicap of the competition game.

2. A game system according to claim 1, wherein the handicaps decided based on the rank difference by the handicap selecting unit contain a handicap that there is no handicap.

3. A game system according to claim 1, wherein the matching control unit presents to said one player the information of said one of the other players to be matched with said one player to make said one player select whether or not the matching with said one of the other players is acceptable, and, when said one player accepts the matching with said one of the other players, sets said one of the other players as the matched competitor.

4. A game system according to claim 1, wherein the matching control unit further comprises a preferential matching unit which, preferentially matches said one of the other players with said one player because said one of the other players has been recorded in said competition score of said one player.

5. A game system according to claim 1, further comprising a match title indicating unit which indicates, in a display unit, a match title of the game which is decided based on the competition score of said matched competitor of said one player.

6. A game system according to claim 1, wherein the game is a quiz game in which the plurality of players answer questions of a plurality of categories, a question constitution of the quiz game is decided based on categories selected by said plurality of players, and the handicap that is decided based on the rank difference by the handicap selecting unit prohibits the higher rank one of said one player and matched competitor from selecting categories.

7. A method for operating a game system comprising a server and a plurality of game devices, the method executing a game in which a plurality of players compete, each of the plurality of players competing at a respective one of the plurality of game devices, said method comprising:

a competition score storing step of storing in a competition score storing unit competition scores of competitions of one player with the other players with respect to each of the other players;

a handicap information storing step of storing in a handicap information storing unit handicap information of a plurality of handicaps which vary a difficulty of winning the competition game for said one player vs. a competitor;

a matching control step of matching one of the other players as a matched competitor with said one player, based on a competition request input of said one player;

a rank deciding step of reading the competition score of said matched competitor from the competition score storing unit, and, based on the competition scores, judging whether the rank of said one player is higher or lower than the rank of said matched competitor and the rank difference between said one player and said matched competitor;

a handicap selecting step of, based on the rank difference, deciding a plurality of handicaps which can be set in the competition game, presenting the decided plurality of handicaps to the lower rank one of said one player and matched competitor, and permitting the lower rank one of said one player and matched competitor to select one from the presented plurality of handicaps;

a handicap deciding step of presenting to the higher rank one of said one player and matched competitor the handicap selected by the lower rank one of said one player and matched competitor, and permitting the higher rank one of said one player and matched competitor to decide whether or not the higher rank one of said one player and matched competitor accepts the selected handicap; and a handicap setting step of reading the handicap information corresponding to the handicap decided in the handicap deciding step from the handicap information storing unit and, based on the handicap information, setting the handicap of the competition game, wherein the above-recited steps are carried out by the server and at least one of the plurality of game devices.

8. The method according to claim 7, wherein the handicaps decided based on the rank difference in the handicap selecting step contain a handicap that there is no handicap.

9. The method according to claim 7, wherein the matching control step comprises:

presenting to said one player the information of said one of the other players to be matched with said one player to make said one player select whether or not the matching with said one of the other players is acceptable, and, when said one player accepts the matching with said one of the other players, setting said one of the other players as the matched competitor.

10. The method according to claim 7, wherein the matching control step further comprises a preferential matching step of, preferentially matching said one of the other players with said one player because said one of the other players has been recorded in said competition score of said one player.

11. The method according to any one of claims 7 to 10, further comprising a match title indicating step of indicating, in a display unit, a match title of the game which is decided based on the competition score of said matched competitor of said one player.

12. The method according to claim 7, wherein the game is a quiz game in which the plurality of players answer questions of a plurality of categories, a question constitution of the quiz game is decided based on categories selected by said plurality of players, and the handicap that is decided based on the rank difference in the handicap selecting step prohibits the higher rank one of said one player and matched competitor from selecting categories.

* * * * *